US006517403B1

(12) United States Patent
Cooper et al.

(10) Patent No.: US 6,517,403 B1
(45) Date of Patent: Feb. 11, 2003

(54) VISUAL DISPLAY

(75) Inventors: Anthony John Cooper, Escondido, CA (US); Floyd R Pothoven, Bellflower, CA (US)

(73) Assignees: Anthony Cooper, Escondido, CA (US); Floyd Pothoven, Bellflower, CA (US)

( * ) Notice: Subject to any disclaimer, the term of this patent is extended or adjusted under 35 U.S.C. 154(b) by 0 days.

(21) Appl. No.: 09/509,713

(22) PCT Filed: Oct. 1, 1998

(86) PCT No.: PCT/US98/20816

§ 371 (c)(1),
(2), (4) Date: Mar. 31, 2000

(87) PCT Pub. No.: WO99/17329

PCT Pub. Date: Apr. 8, 1999

Related U.S. Application Data

(60) Provisional application No. 60/067,508, filed on Dec. 4, 1997.

(30) Foreign Application Priority Data

Oct. 1, 1997 (GB) ..... 9720723

(51) Int. Cl.[7] ..... H01J 9/26
(52) U.S. Cl. ..... 445/25; 445/41
(58) Field of Search ..... 445/24, 41, 59, 445/25

(56) References Cited

U.S. PATENT DOCUMENTS

| | | | | | |
|---|---|---|---|---|---|
| 4,158,485 | A | * | 6/1979 | Mueller et al. | 349/153 |
| 5,587,720 | A | * | 12/1996 | Fukuta et al. | 313/309 |
| 5,697,825 | A | * | 12/1997 | Dynka et al. | 445/25 |
| 5,788,551 | A | * | 8/1998 | Dynka et al. | 445/25 |
| 5,813,893 | A | * | 9/1998 | Robinson | 445/25 |
| 5,820,435 | A | * | 10/1998 | Cooper et al. | 445/25 |
| 6,139,390 | A | * | 10/2000 | Pothoven et al. | 445/24 |
| 6,254,449 | B1 | * | 7/2001 | Nakanishi et al. | 445/25 |

FOREIGN PATENT DOCUMENTS

| | | | |
|---|---|---|---|
| FR | 02739490 A | * | 4/1997 |
| JP | 61 071533 A | * | 4/1986 |
| JP | 2-129828 A | * | 5/1990 |
| WO | WO 9615542 A | * | 5/1996 |
| WO | WO 9826440 A | * | 6/1998 |

* cited by examiner

*Primary Examiner*—Kenneth J. Ramsey
(74) *Attorney, Agent, or Firm*—Ware, Fressola, Van Der Sluys & Adolphson

(57) ABSTRACT

The apparatus for sealing face plates (753) and cathodes (754) has three stations (701, 702, 703). The first (701) is a preheater, the second (702) is an alignment and irradiation station and the third (703) is a controlled cooling station. Beneath each station, a vacuum pump (710) capable of drawing ultralow pressures is provided. The preheater is equipped with upper and lower banks of radiant heaters and reflectors (712). The upper heaters are Provided above a quartz: window (713) of a chamber (714) constituting the station. The pressure in the preheater is pumped down to that in the alignment and irradiation station prior to opening of the gate valve between them and transfer of the face plate and cathode. At the alignment and irradiation station, further heaters (716) are provided. Those above the face plate and cathode, the face plate being uppermost, are mounted on frames (717) about hinges (718), whereby they can be swung up to clear this station's top quartz window, exposing the face plate to the view of an optical system (719) and a laser (720). Manipulation controls (722) are provided for manipulating the position of the face plate to be pixel alignment, as measured by the optical system (719), with the cathode. The laser is traversed around further. The cooling station (703) has meanwhile been pumped down and the sealed device is transferred to it. The temperature of the device is allowed to rise very slowly, in order to reduce the risk of thermal cracking to as great an extent as possible. As the temperature slowly falls, air is slowly introduced, so that the finished device can be removed to the ambient surroundings.

44 Claims, 20 Drawing Sheets

VISUAL DISPLAY

This application is a 371 of PCT/US98/20816 filed Oct. 1, 1998 which claims benefit of Provisional Application Serial No. 60/067,508 filed Dec. 4, 1997.

FIELD OF THE INVENTION

The present invention relates to a visual display, particularly though not exclusively for use with data processing apparatus.

BACKGROUND OF THE INVENTION

Visual displays for data processing apparatus, such as computers, are normally field emission displays of the cathode ray tube type. These generally have a depth of the order of their size dimension, which conventionally is their corner to corner or diagonal dimension. This depth can render them inconvenient in use. Recently, laptop computers have become increasingly widely used. These incorporate a "flat" screen display, usually of the liquid crystal type.

Proposals have been made to provide displays having flat screen cathode ray tubes. These are known as Spindt cathodes, after the inventor of U.S. Pat. No. 3,755,704. In this specification, they are referred to as field emission devices.

OBJECT OF THE INVENTION

The object of the present invention is to provide an improved method of sealing a "flat" screen field emission visual display and a machine therefor.

This application claims priority from our UK application No. 9720723.7 of Oct. 1, 1997 and Provisional Application No. 60/067,508 of Dec. 4, 1997. The priority applications describe both our field emission device invention and its manner of sealing into a display and a machine therefor. This specification describes both aspects and claims our sealing invention. A copending application filed on the same date herewith (PCT Ser. No. 08/766,474) similarly describes both aspects and claims the field emission device invention.

THE INVENTION

According to a first aspect of the invention there is provided a method of sealing a visual display having:

- at least one field emission device including an emission layer on a substrate;
- a glass face plate carrying excitable phosphor material; and
- fused sealing material peripherally sealing the face plate to the emission device(s), whereby the face plate is parallelly spaced from the emission layer, the method consisting in the steps of:
- evacuating the display, to evacuate the space between the emission layer and the face plate; and
- irradiating a peripheral region of the face plate to fuse the sealing material, thereby sealingly securing the face plate to the emission device(s).

Preferably the face plate is positioned in pixel to pixel alignment with the emission device(s) subsequently to the start of the evacuation, preferably by robotic manipulation.

In accordance with a preferred feature of the invention, the irradiation is performed by traversing along the sealing material with an irradiation source, the traversing being by movement of the irradiation source or the face plate and emission device(s) or both.

In one embodiment, preliminarily to the traversing, irradiation is carried out at spaced intervals around the fusible sealing material to tack the face plate in position.

Normally, and in particular where the sealing material is fusible glass frit, the irradiation step is performed with a laser.

A plurality of lasers may be used for the irradiation step, either in sequence to assure complete flising of the frit and/or at opposite positions to allow speedy traverse.

Conveniently, at least a final part of the evacuation step is simultaneous with the irradiation step, particularly where frit is so shaped as to be able to bridge a face plate/carrier gap established by the height of spacers between the face plate and the emission layer of the emission device(s). Nevertheless, it can be envisaged that the evacuation and irradiation steps are carried out at sequential stations.

As an alternative wherein the sealing material is fusible under ultra-violet light, the irradiation step is performed by an ultra-violet light source, preferably with a mask restricting the irradiation to irradiate the adhesive only. In this alternative, a peripheral glass wall may be provided with UV curable adhesive at one surface in abutment with the face plate and at an opposite surface in contact with the carrier (see below) or the emission device and the irradiation fuses the adhesive at both surfaces. It can be envisaged that the carrier for the emission device may be of glass and permeable to UV light, whereby a spacer of the carrier—or indeed of the emission device—from the face plate may have UV curing adhesive at both its top and bottom.

Normally the emission device(s) will be supported on a carrier and the method includes the step of preliminarily sealing the device(s) to the carrier.

Where the carrier supports a plurality of emission devices and the method may include the steps of:

- positioning the emission devices in pixel line alignment and
- provisionally securing the devices with respect to the carrier, prior to sealing, preferably by means of wedges between the emission devices and peripheral portions of the carrier.

The wedges can be of gettering material.

Alternatively, the emission devices and the carrier may be so complementarily spaced that they come into pixel line alignment on assembly into the carrier.

In the preferred embodiment, the emission device(s) are sealed to the carrier by soldering, the device(s) and the carrier being heated for melting of the solder and cooled for setting of it, the cooling preferably being provided on evacuation of a vacuum chamber with an outlet from the chamber directing air flow from the chamber to the solder joint for its cooling.

Whilst the carrier and emission device(s) can be heated to above the melting point of the solder in the vacuum chamber where the fusing of the sealing material is carried out, preferably they are heated to this temperature in a preceding vacuum chamber. Alternatively, it is possible for the soldering to be carried out in the ambient atmosphere.

The method preferably includes preliminary cleaning of the face plate and/or the emission device(s) by irradiating it or them with one or more electron beams and/or ion streams. This cleaning can be in the ambient atmosphere or under partial or complete vacuum.

Preferably the cleaning is carried out with a field effect emission device of the invention.

The method preferably includes including a step of irradiation of an activatable getter for final evacuation of the display. Particularly where the sealing irradiation is by laser, the getter irradiation is by a laser.

Apparatus for sealing a visual display having a field emission device with an emission layer on a substrate and a face plate with excitable phosphor material, the apparatus comprising:

a vacuum chamber, preferably including its own evacuation pump;

means in the vacuum chamber for supporting the field emission device and the face plate juxtaposed in pixel to pixel alignment; and an irradiation device adapted and arranged to irradiate sealing material provided on the device or the face plate thereby fusing the material to seal the visual display.

Whilst it is envisaged that the irradiation device can be mounted inside the vacuum chamber; in the preferred embodiments, the irradiation device is mounted outside the vacuum chamber, the chamber being provided with a window through the irradiation can pass.

The preferred irradiation device is a laser; although it can be a ultraviolet light source.

Preferably, wherein the support means includes a manipulator for manoeuvring one of the field emission device and the face plate into pixel to pixel alignment with the other, and the apparatus includes means for measuring the relative position of the emission device and the face plate, whereby the manipulator can position them in pixel to pixel alignment.

Particularly where the irradiation device is a laser, the apparatus preferably includes heater(s) for heating the emission device and face plate prior to irradiation. Preferably, at least some of the heaters of the vacuum chamber are arranged outside the window provided for the irradiation to enter the chamber. Conveniently, these heaters are arranged on a frame so that they can be swung, preferably about hinges, clear of the window to expose it to the irradiation device In one preferred embodiment, the apparatus includes a pre-heating and preliminary evacuation chamber provided with heater(s), an evacuation pump and means for transferring the emission device and face plate to the vacuum chamber.

Preferably, the apparatus also includes a cooling chamber provided with means for controlling the cooling of the visual display and means for transferring the visual display from the vacuum chamber. Normally, the transfer means are adapted to transfer the emission device(s) as assembled onto a carrier.

Preferably, the heaters of the preliminary evacuation chamber are adapted to heat the emission device(s) and the carrier to sufficient temperature to melt solder and the evacuation means is adapted to direct evacuated air flow to the solder region to cool it after melting.

Further the apparatus preferably includes means for manoeuvring the emission device(s) with respect to the carrier for their soldering in desired relative position.

In one preferred embodiment, the sealing apparatus includes a robotic input station and removable input pods adapted to be connected thereto, the removable input pods being adapted to accommodate a plurality of emission devices and face plates, preferably in cassettes themselves removably mounted in the input pods. The robotic input station is adapted to unload the emission devices and the face plates from the input pods for processing in the apparatus. The removable input pods conveniently include means for their heating and/or evacuation.

Preferably, a robotic output station with a removable output pod is also provided. The robotic output station is adapted to remove sealed displays from the vacuum chamber and load them into an output pod, the latter having means for controllably returning the sealed displays to ambient pressure and temperature.

DRAWINGS OF THE PREFERRED EMBODIMENTS OF THE INVENTION

To help understanding of the invention, specific embodiments of it will now be described by way of example and with reference to the accompanying drawings, in which.

DESCRIPTION OF A FIRST EMBODIMENT OF THE EMISSION DEVICE

Figure 1:
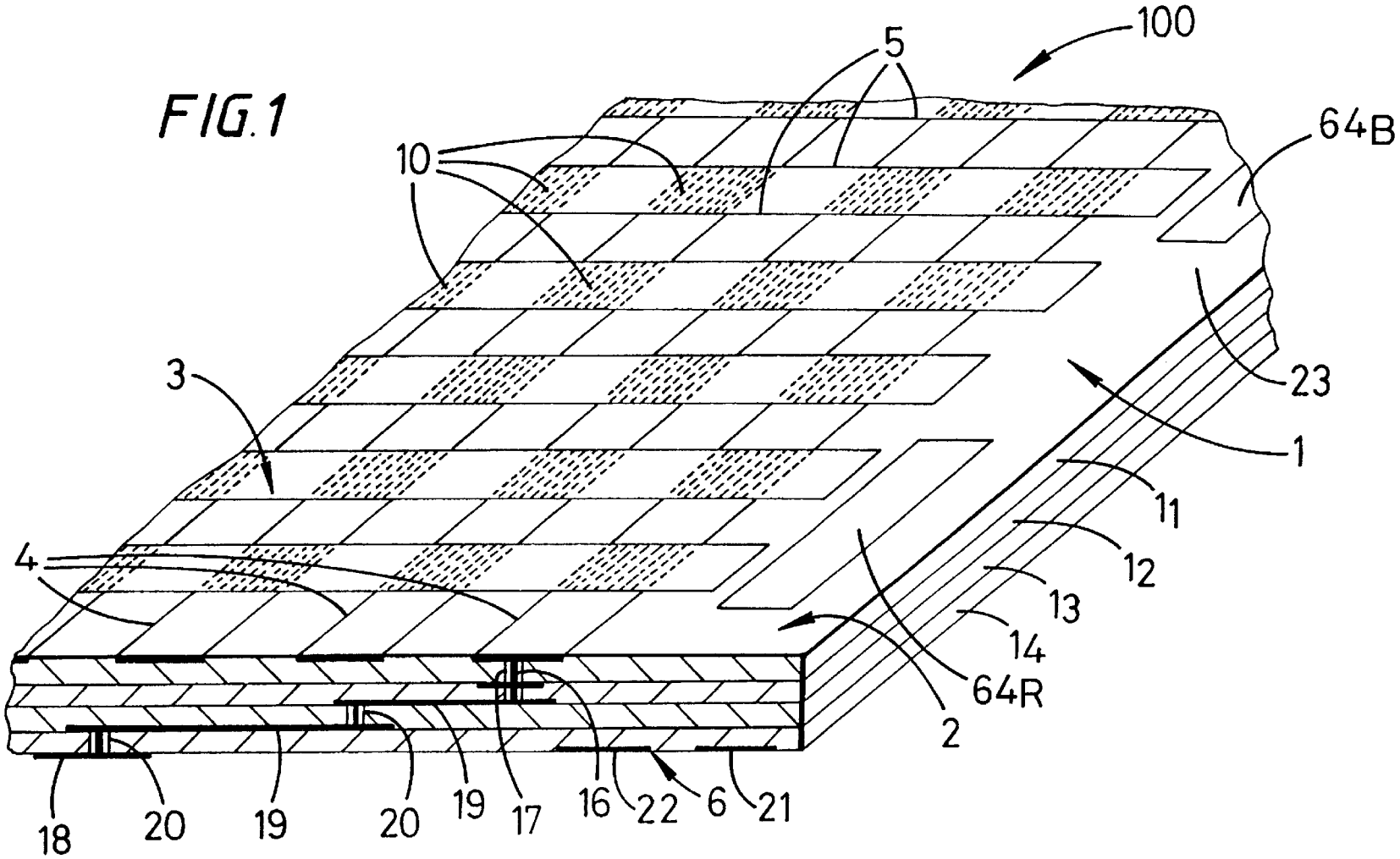
FIG. 1 is a perspective view of a part of an emission device of the invention.
Figure 2:
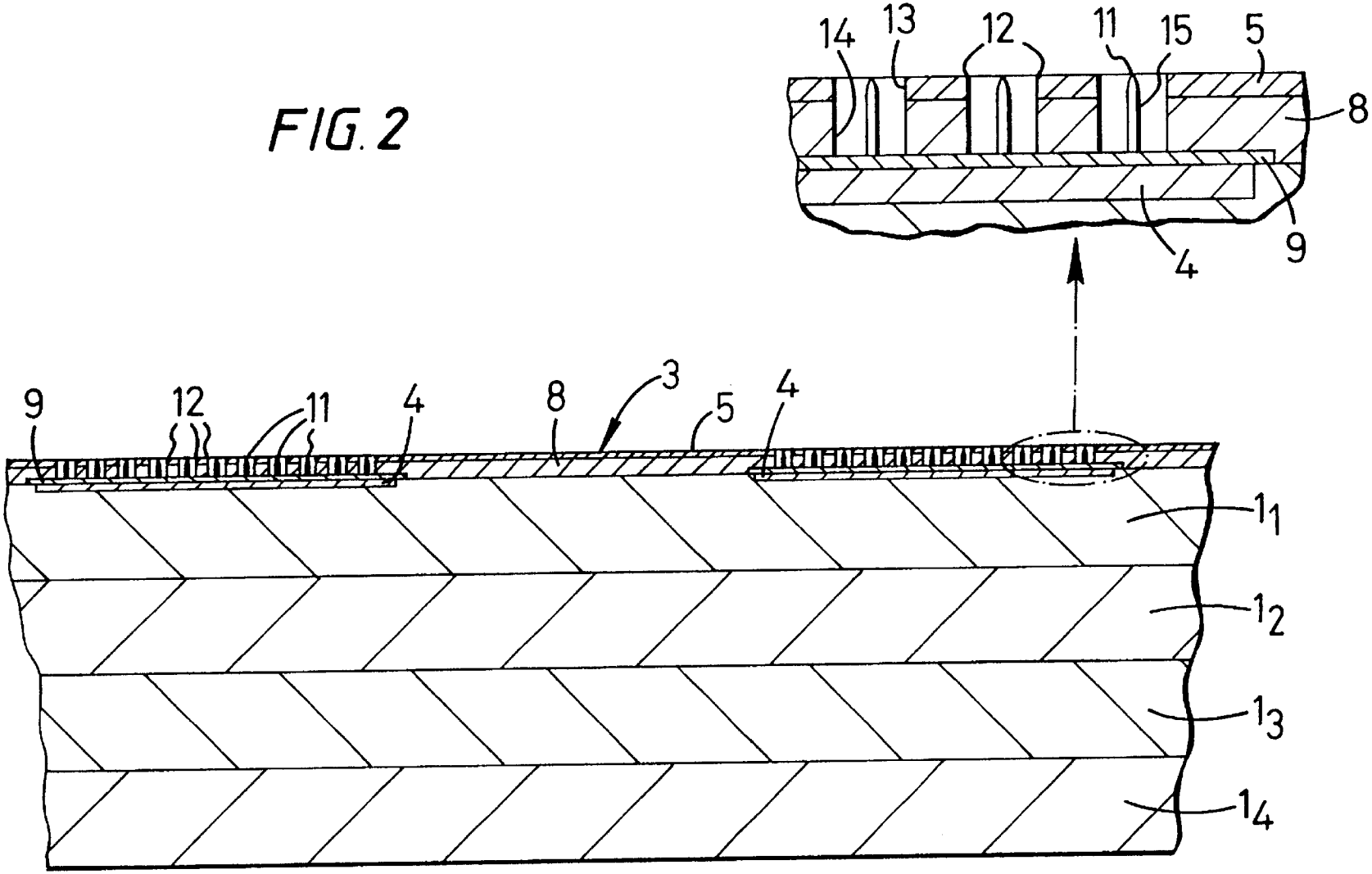
FIG. 2 is a scrap cross-sectional view on a larger scale through the device of FIG. 1, with a further enlarged detail.

Referring to FIGS. 1 and 2, there is shown a representative part of a field effect emission device 100 for a visual display having a ceramic substrate 1. For compatibility with other components of the visual display, in particular a glass face plate (see below), the ceramic used for the substrate is alumina. On an emission side 2 of the substrate, it has an emission layer 3 including a lattice of conductive emitter and gates line stripes 4,5. In use, on a driver side 6 of the substrate, it has drivers 7 mounted and connected, as will be described in more detail below, see FIG. 30. Provision of the drivers so close to the emission layer which they are driving minimises capacitative and other electrical losses.

The emitter stripes are of nickel and the gate stripes are of chromium. The respective stripes of the same type are spaced across the substrate. They are separated at their intersections by a dielectric layer 8 and a thinner resistive layer 9 on the substrate side of the dielectric layer. The dielectric layer is of silicon dioxide. The resistive layer can be of polycrystalline silicon or metal oxide. The emitter stripes are recessed into the surface of the emission side of the substrate, whereby the dielectric and resistive layers are planar. Typically, the stripes are arranged at a pitch of 80 per inch, i.e. at 0.0125" centres. Each stripe is 0.004" wide and 0.0004" thick.

At each intersection, an emission pixel 10 is provided. Each emission pixel has an array of emitters 11 and gates 12. The gates are openings 13 in the gate stripe 5 at the intersection, with aligned openings 14 in the dielectric layer 8. The emitters are elements 15 deposited on the resistive layer 9 over the emitter stripe 4 at the intersection, in the openings 13,14 in the gate stripe and the dielectric layer. Typically 300 emitters are provided per pixel.

For electrical connection to the emitter and gate stripes, the substrate has apertures 16, into which the strip material—or other conductive material, see below extends as vias 17. The gate vias extend through the dielectric and resistive layers as well as the substrate.

To facilitate soldered, electrical connection to driver chips 7 (see below) connected to the back face of the device at contact pads 18, the device substrate is made up of several substrate layers $\mathbf{1}_1$, $\mathbf{1}_2$, $\mathbf{1}_3$, $\mathbf{1}_4$ bonded together. Each layer piece has connection strips 19 set into its opposite surfaces and interconnecting vias 20, of the same material as the strips. The connection strips of adjacent layers abut or at least vias of one layer abut with connection strips of the next layer, providing electrical contact. The connection strips and the vias are arranged to spread or fan out the connections from the stripe pitch, typically 0.0125", to that of driver chip contacts, typically 0.050", to be connected to the contact pads 18. Where more lines to the inch are used, the stripe pitch will decrease, requiring more pronounced fan out.

Peripherally, the back/driver surface of the outer substrate layer $\mathbf{1}_4$ has an electrically isolated, screen printed, continuous metallic strip 21—similar to the pads 18—for sealing connection of the device to a carrier, described in more detail below. Power and signal supply tracks 22 are also provided on the back surface for powering the drivers and providing control signals to them.

The emission device has edge zones 23, along the four edges of the ceramic substrate, into which the emitter and gate lines do not extend. Spaced along two opposite edge zones, the emission device has red, blue and green colour lines drive contacts $\mathbf{64}_R$, $\mathbf{64}_B$, $\mathbf{64}_G$ on its emission side. These contacts are printed on top of the dielectric layer and connected by vias and connection strips to driver contact pads on the back surface of the substrate.

Each layer is of the order of 0.010" to 0.020" thick.

Manufacture of the above emission device will now be described. Other embodiments of emission device will be described below.

Description of the Preferred Method of Manufacture of the Emission Device

Figure 3:
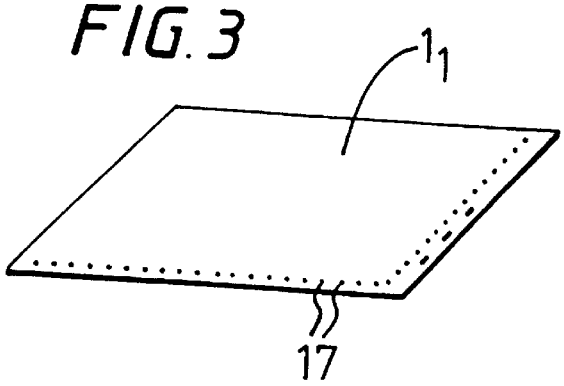
FIG. 3 is a perspective view of a stamped and apertured substrate, ready for screen printing of the emitter stripes.

The emission device of FIG. 1 is manufactured as follows:

The individual layer pieces $\mathbf{1}_1$, $\mathbf{1}_2$, $\mathbf{1}_3$, $\mathbf{1}_4$ of the alumina substrate 1 are formed by tape casting. The pieces are stamped from the tape cast material and have apertures 16 for the vias 17 cut in by photo-resist etching of fired ceramic or punching of the material in its green state. The array of via apertures shown in FIG. 3, is illustrative only. Every emitter line and every gate line must have at least one via and preferably two. The arrangement shown in FIG. 3 has all the gate vias aligned and all the emitter vias aligned. Whilst this is convenient for logical layout, it causes lines of weakness. An improved layout is described below. Further it is convenient to form the emitter via apertures first.

Figure 4:
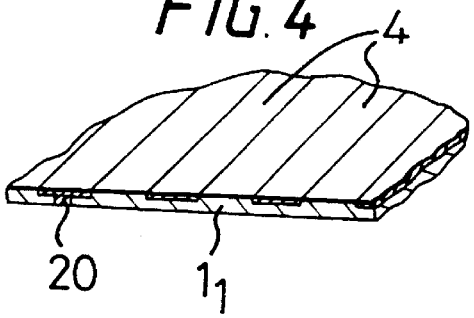
FIG. 4 is a scrap view on a larger scale of the piece of FIG. 3 after screen printing of the emitter stripes.

Whilst the pieces are still green, the emitter stripes are screen printed as a powdered metal slurry onto the top one $\mathbf{1}_1$ of the pieces. Similarly connection strips 19 are screen printed on the other pieces $\mathbf{1}_2$, $\mathbf{1}_3$, $\mathbf{1}_4$. The screen printed material passes into the apertures to form the vias 20, the emitter stripe material filling the emitter via apertures and the connection strip material, which is typically silver based, filling the interconnection via apertures. The pieces are then individually compressed between platens to press the emitter stripes 4 and the connection strips 19 into the surfaces of the respective substrate pieces, see FIG. 4.

Figure 5:
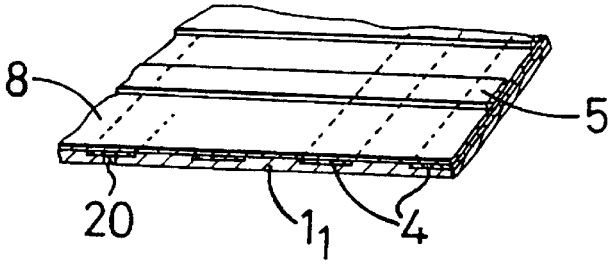
FIG. 5 is a similar view of the piece after screen printing of the gate lines.
Figure 6:
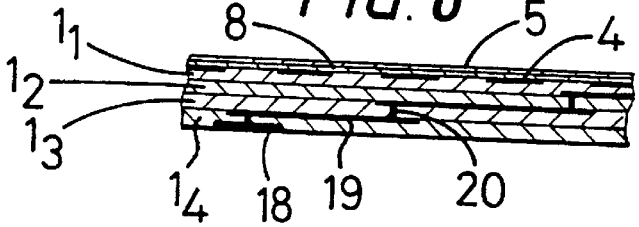
FIG. 6 is side view of the plurality of substrate pieces assembled for firing.

Next, the dielectric and resistive layers 8,9 are added to the top one $\mathbf{1}_1$ of the pieces by spinning. The resistive layer is required only at the intersections of the emitter stripes and the gate stripes and can be etched away elsewhere before dielectric layer is added. Via apertures (not shown) for the gate stripes 5 are formed and the stripes are printed on and through the apertures, see FIG. 5. All the layer pieces making up the substrate are then stacked and pressed together to ensure contact between respective connection strips and vias in adjacent layers. The assembly is fired, see FIG. 6.

Figure 7:
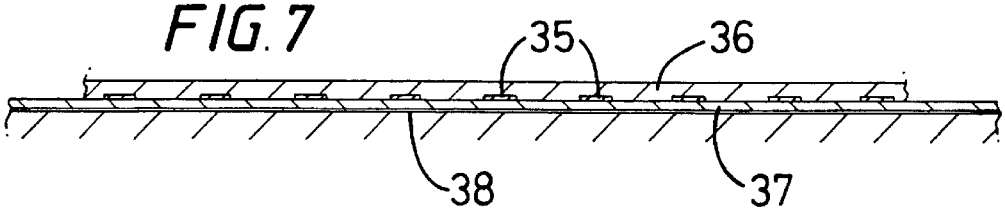
FIG. 7 is a scrap side view of another substrate and electrical connection track lay up method.

As an alternative to screen printing the conductive layers onto the green substrate, the conductive tracks 35, at for one side of a substrate layer 36, can be screen printed onto a release film 37, supported by a flat surface 38, as shown in FIG. 7. The substrate material 36 is then tape cast over the conductive tracks, whereby a smooth level surface is achieved across the boundaries of the materials. The release material, which is shown in FIG. 7 with exaggerated thickness, is peeled off when the tape casting has set, for subsequent operations, including via formation and substrate build up. With this method, the vias will require to be filled as a separate operation from laying down of the conductive tracks onto green substrate. This alternative method is applicable also to emitter lines laid onto a release film and overlaid with tape cast ceramic. The resistive layer also may be laid by screen printing—first—preferably in the pattern described above, that it is only at the intersections between the emitter and gate line stripes. After build up of the substrate and its firing, the top layer is preferably polished to provide as even surface onto which the emitters are deposited, so that they are consistent and level with each other.

Figure 8:
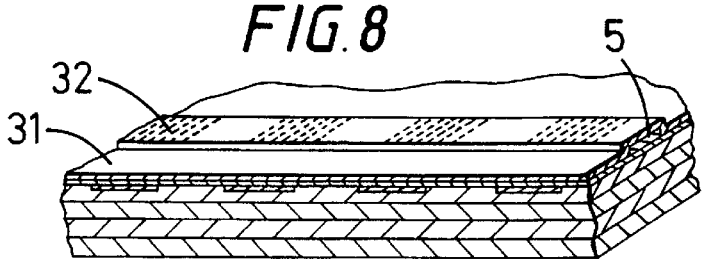
FIG. 8 is a view similar to FIG. 5 showing a photo-resist layer for controlling etching of the gates.

After firing, the gates and voids are made by micro-machining. Then the emitters are electrolytically deposited and micro-machined. This is achieved by depositing a photo-resist layer 31, see FIG. 8, on the emission side of the substrate, selectively exposing and developing it, etching openings 32 in it where the gate openings are to be formed. A separate etching process forms the gate openings 13. A further etching process forms the openings 14 in the dielectric layer down to the resistive layer 9. Not only is this electrically resistive, but also it is resistant to further etching.

Once the etching is complete, the emitters 11 are formed by building nickel onto the resistive layer where it is exposed at the bottom of the openings 14 in the dielectric. This can be either by vacuum deposition or by electro-deposition. The man skilled in the art will perform this process without the need for further description here.

Description of a Further Embodiments of the Emission Device

Figure 9:
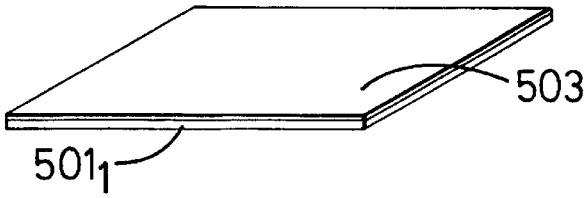
FIG. 9 is a perspective view of a second emission device of the invention.
Figure 10:
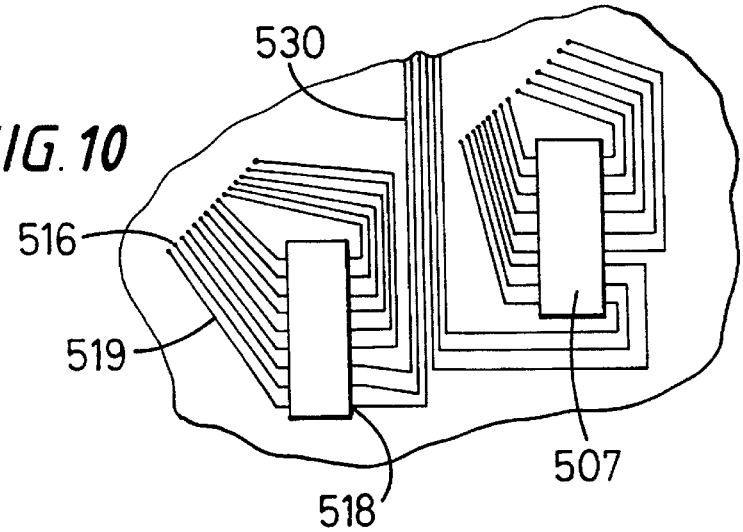
FIG. 10 is a scrap plan view of the back surface of the second emission device.

Referring now to FIGS. 9 & 10, the simplest form of emission device of the invention is there shown. It has a single ceramic layer. On its emission side is provided an emission layer 503 similar to the emission layer 3. As such it requires no further description. This device suffers from the disadvantage that the fan out of conductive tracks 519 on the back side of the substrate layer $\mathbf{501}_1$ from vias 516 to contact pads 518 requires a tortuous layout of the tracks, bearing in mind that power and signal tracks 530 must also be provided to the driver chips 507 and that in FIG. 10 the pitch of the vias has been shown as half that of the driver chip pins, whereas in practice, the via pitch is likely to be smaller still by comparison. It should be noted also that whilst FIG. 10 shows an ideal line 1 to pin 1 . . . line n to pin n fan out, in reality the order of the pins is likely to cause a more complex layout to be necessary. Further, bearing in mind that the device must be pressure tight, in order to maintain the internal vacuum, the device suffers from the disadvantage of relying on complete filling of the apertures for pressure integrity. Nevertheless it is anticipated that there may be applications for this simplest form of the emission device of the invention.

Figure 11:
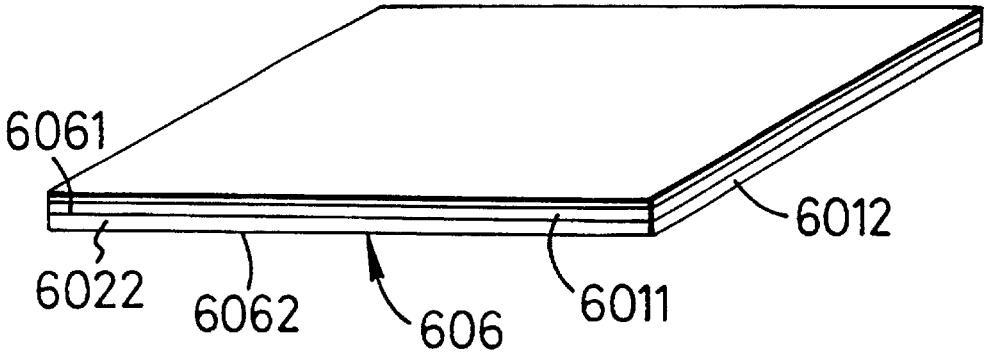
FIG. 11 is a view similar to FIG. 9 of a third emission device of the invention.
Figure 13:
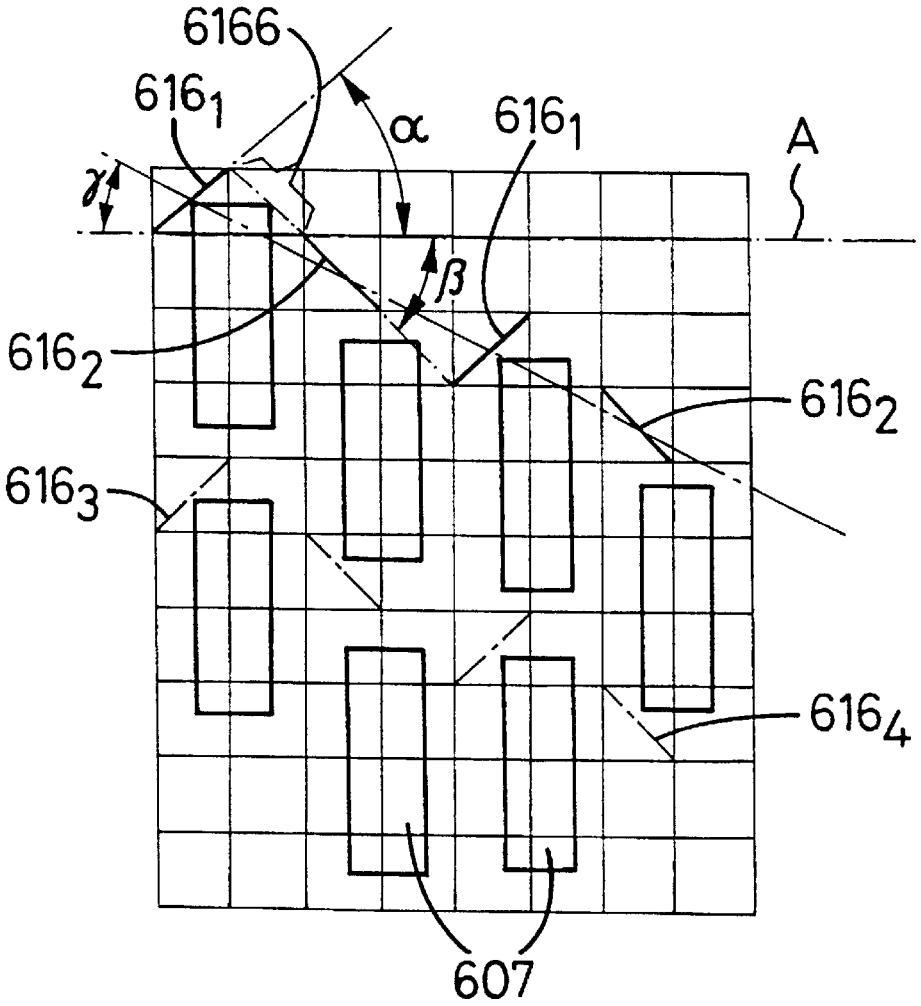
FIG. 13 is a diagrammatic plan view of the layout of vias in the front substrate layer and respective driver chips on the back face for the emission device of FIG. 11.
Figure 12:
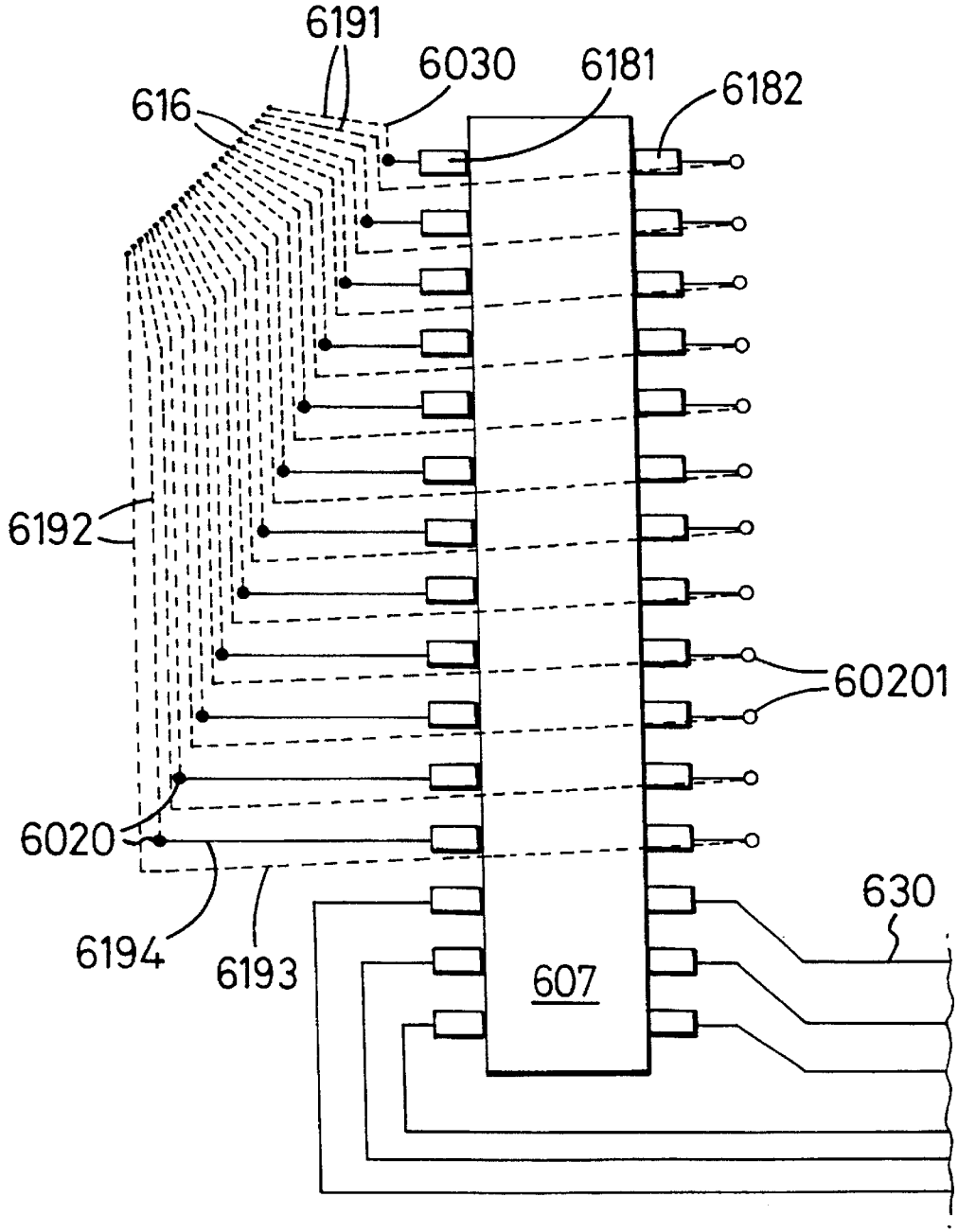
FIG. 12 is a scrap view similar to FIG. 9 from the back of the third emission device of the invention, showing in particular vias and conductive tracks, with the substrate layers not shown as such.

Referring now to FIGS. 11, 12 & 13, the emission device there shown has two ceramic layers 6011,6012. The back face 606 of the first layer has interconnection tracks 6191 extending from emitter line (for instance) vias 616 in the front substrate layer 6011, see FIG. 12. It should be noted that in FIG. 12, the individual layers as such are not shown, but the layout of the tracks on them is shown. The front face 6022 of the second layer 6012 also has interconnection tracks 6192, the two sets tracks 6191,6192 interconnect where they abut. The tracks 6191 fan out the pitch of the vias 616 to the pitch of the interconnection points 6030 by a factor of two. The tracks 6192 fan out again by being of sequentially longer length so that their ends are again at doubled pitch. Alternate ones of these ends have a via 6020 to tracks 6194 to chip pads 6181. Since it is alternate tracks which have vias at their ends, the via pitch is again doubled, i.e. it is fanned out by a factor of eight from the pitch of the vias 616 in the front layer. The alternate tracks 6192 not having vias 6020 are continued transversely to further vias 60201 on the other side of the chip 607, with back surface tracks leading back to pads 6182 on the other side of the chip. Power and signal lines 630 also lead to the chip. It will be appreciated that the two substrate layers gives far greater flexibility in fan out than is possible with one layer, in that the tracks 6191,6192,6193 could if need be cross the power and signal tracks 630 to the driver chip 607. Alternatively, power and signal tracks can be more flexibly laid out in that they can pass by vias to the layer interface so that their relative order can be reorganised for instance. Further the vias 616,6020 in both ceramic layers are blanked of by piece of the ceramic substrate of the other layer, with the vias not being co-axial. This provides greater assurance of vacuum tightness.

In this embodiment, as shown in FIG. 13 which is strictly diagrammatic, the vias, at least to the emitter and gate stripes are spaced in an array of aligned series of vias in two alternate—in fact equal and opposite—orientations $\alpha,\beta$ to for instance the emitter line orientation A. Within the array, all the series are parallel to one or other of the orientations $\alpha,\beta$. In one band across the substrate in the direction A, there are four aligned via series $\mathbf{616}_1,\mathbf{616}_2,\mathbf{616}_3,\mathbf{616}_4$. These represent two series $\mathbf{616}_1,\mathbf{616}_2$ of emitter vias and two series $\mathbf{616}_3,\mathbf{616}_4$ of gate vias. Within each series, successive vias are to successive emitter or gate lines, and a relatively small number of vias are arranged in each series, say 25, which represents ¼" (transversely of direction A, the actual length trigonometrically depending on the orientation a to the direction A) in a 100 line per inch display. Providing such a short series localises the weakening of the substrate layer introduced by the vias. From one of the series $\mathbf{616}_1$, the next of the series $\mathbf{616}_2$, i.e. the vias for the next 25 lines, is spaced by a gap 6166 from the previous one and set at the other orientation $\beta$. This introduces a transverse line of weakness. Provision of the gaps ensures that the overall weakness is minimised. The array is in effect a zig zag array with gaps 6166 between the zigs and the zags and an orientation y of the aligned series. It will be noted that the arrangement, shown in FIG. 13, spreads the via series horizontally of the Figure at twice the pitch as vertically. Thus the series $\mathbf{616}_1,\mathbf{616}_2$ will cross the emission device horizontally whilst reaching only half its height. Thus to make contact with all the emitter lines, it must be restarted again half way down the device. If the array of series is closed up horizontally, it is possible to avoid restarting. A particular configuration of the array which may be used is one in which the orientations β & γ are both equal to 45°. In this case, the series $616_2$ are all not only parallel but themselves aligned. However weakness is avoided by the gaps. Further, to provide two vias per line, the array of series can be started again, with the starting point spaced horizontally as opposed to vertically as discussed above.

The series $616_3$,$616_4$ is for gate lines. Although these lines run transversely to the emitter lines, there are the same number and they are at the same spacing all over the emission layer. Thus their vias are set in a precisely similar pattern.

With each series of vias in the front face, a chip 607 is associated on the back face, conveniently in one for one correspondence. However one chip may service two series of vias or vice versa. As shown in FIG. 13, all the chips are set to the same side of the vias. However, it will be appreciated that where the vias are close to an edge of the emission device, it is convenient to place the chips in board of the vias. Further, where driver chips having hundreds of driver output connections, in a rectangular array, are provided the chip to via series relationship will not be one to one and the fan out will be considerably more complex than that shown in FIG. 12, but essentially within the ability of the man skilled in the art.

Description of the Preferred Embodiment of Visual Display

Figure 14:
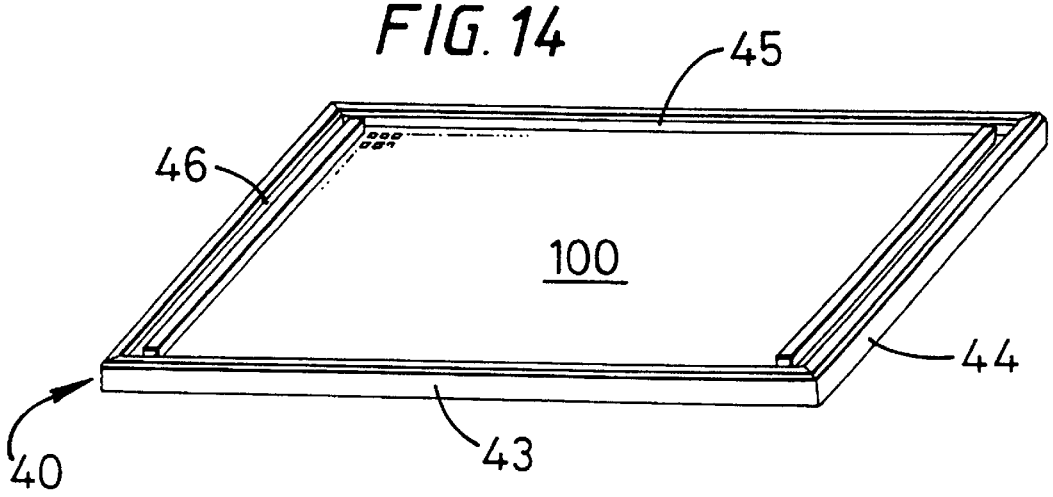
FIG. 14 is a perspective view of a visual display unit of the invention before fitting of its face plate.
Figure 15:
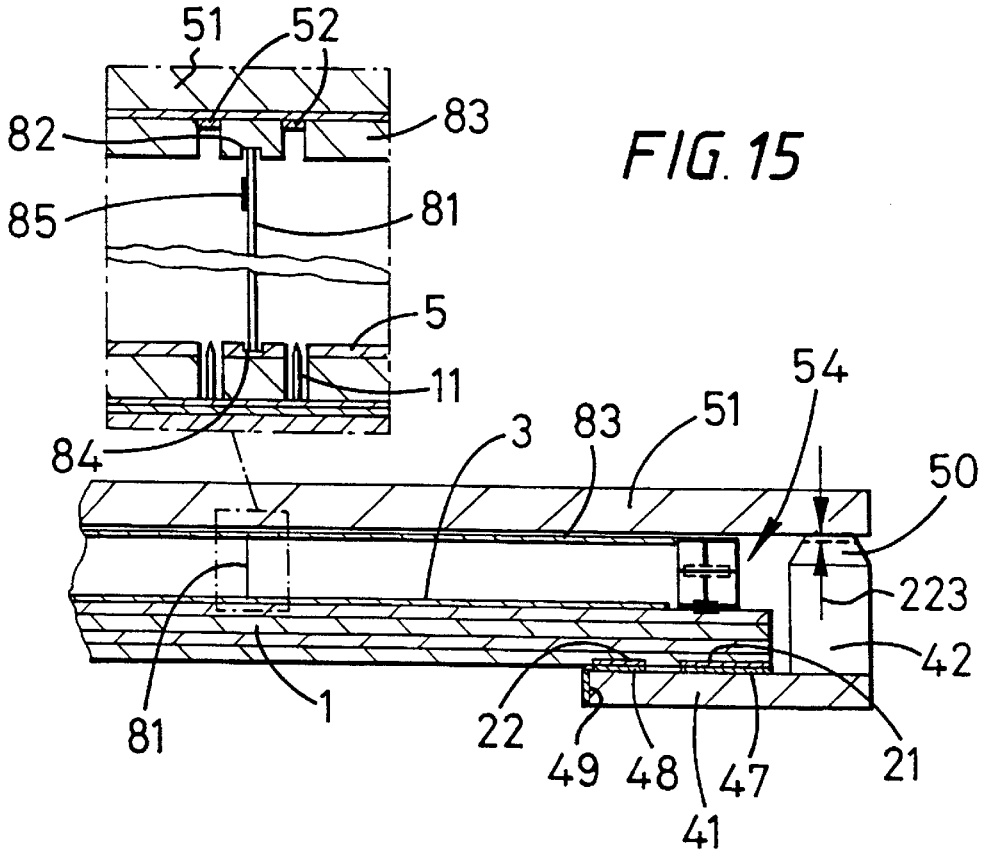
FIG. 15 is a scrap cross-sectional view on a larger scale of part of the device of FIG. 9 with its face plate fitted, with a further enlarged detail showing an inner spacer.

The visual display shown in FIGS. 14 & 15 includes the emission device 100 of FIGS. 1 to 6 and a carrier 40. This is tape cast of alumina material. It has a L-shape cross-section, comprising a foot flange 41 and an upstanding wall or web 42. These are separately tape cast and assembled together prior to firing. Four lengths 43, 44, 45, 46, corresponding to the four sides of the carrier at the four sides of the emission device 100, are arranged with butt joints at the corner. The flanges 41 have a continuous metallic track 47, complementary to the continuous metallic strip 21, screen printed and pressed into the surface of the ceramic on prior to firing. Similarly there are provided contacts 48 on the flange complementary to the supply tracks 22. The material of the contacts is continued onto the inwards facing surfaces 49 of the carrier for providing electrical contacts as described in more detail below.

As described below, the emission device 100 is soldered into the carrier 40. A sealing wall 50 of glass frit is provided around the top of the web 42. A glass front face plate 51 is mounted on the sealing wall at a predetermined spacing from the emission layer of the emission device. The inside surface of the face plate has phosphor material 52 printed on it for selective excitation by the emission device pixels.

Figure 30:
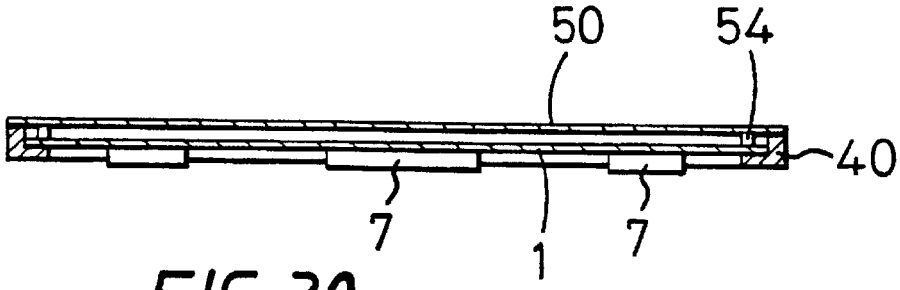
FIG. 30 is a cross-sectional side view of a visual display unit of the invention, complete with driver chips.
Figure 32:
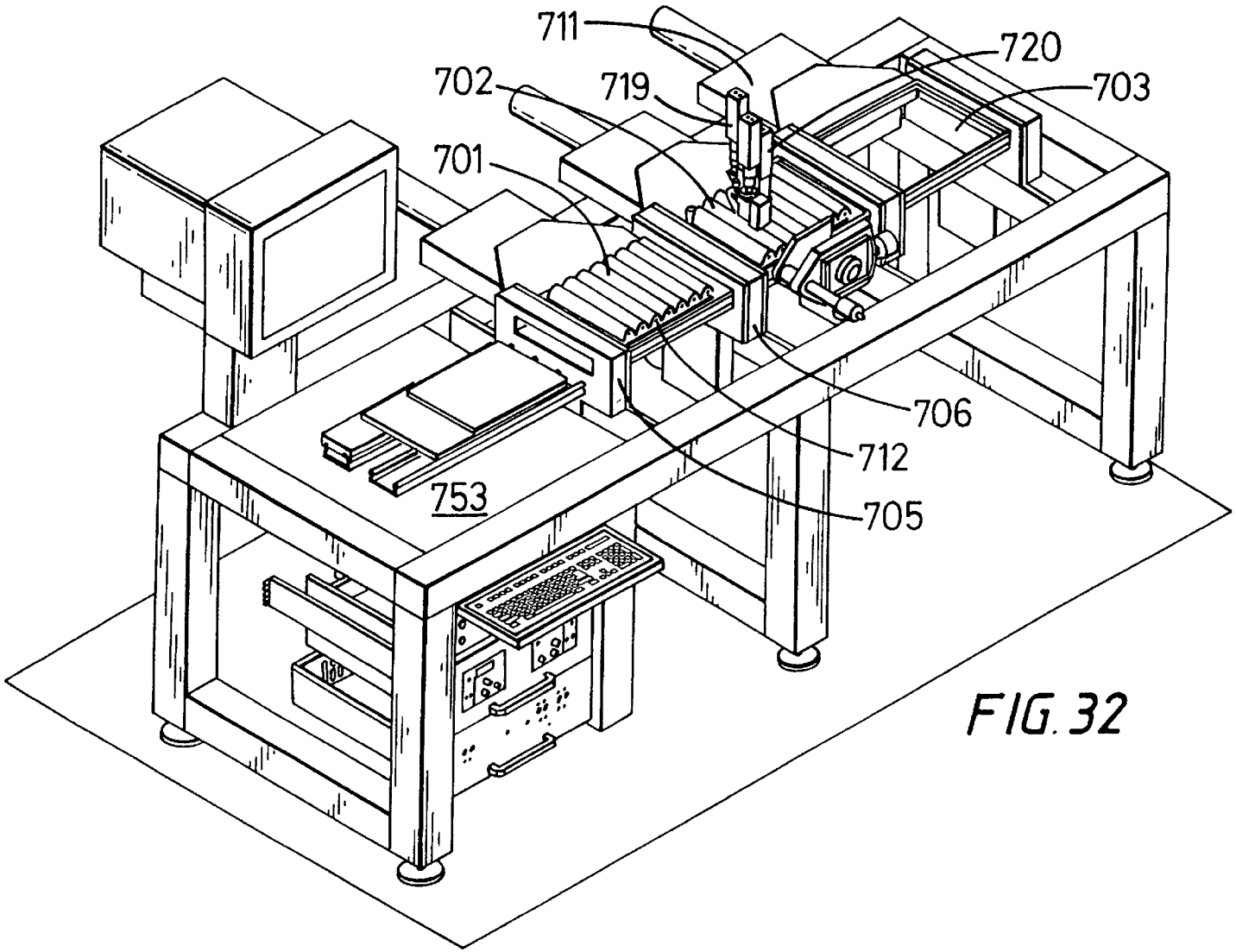
FIG. 32 is a perspective view of a second embodiment of a sealing machine of the invention.
Figure 33:
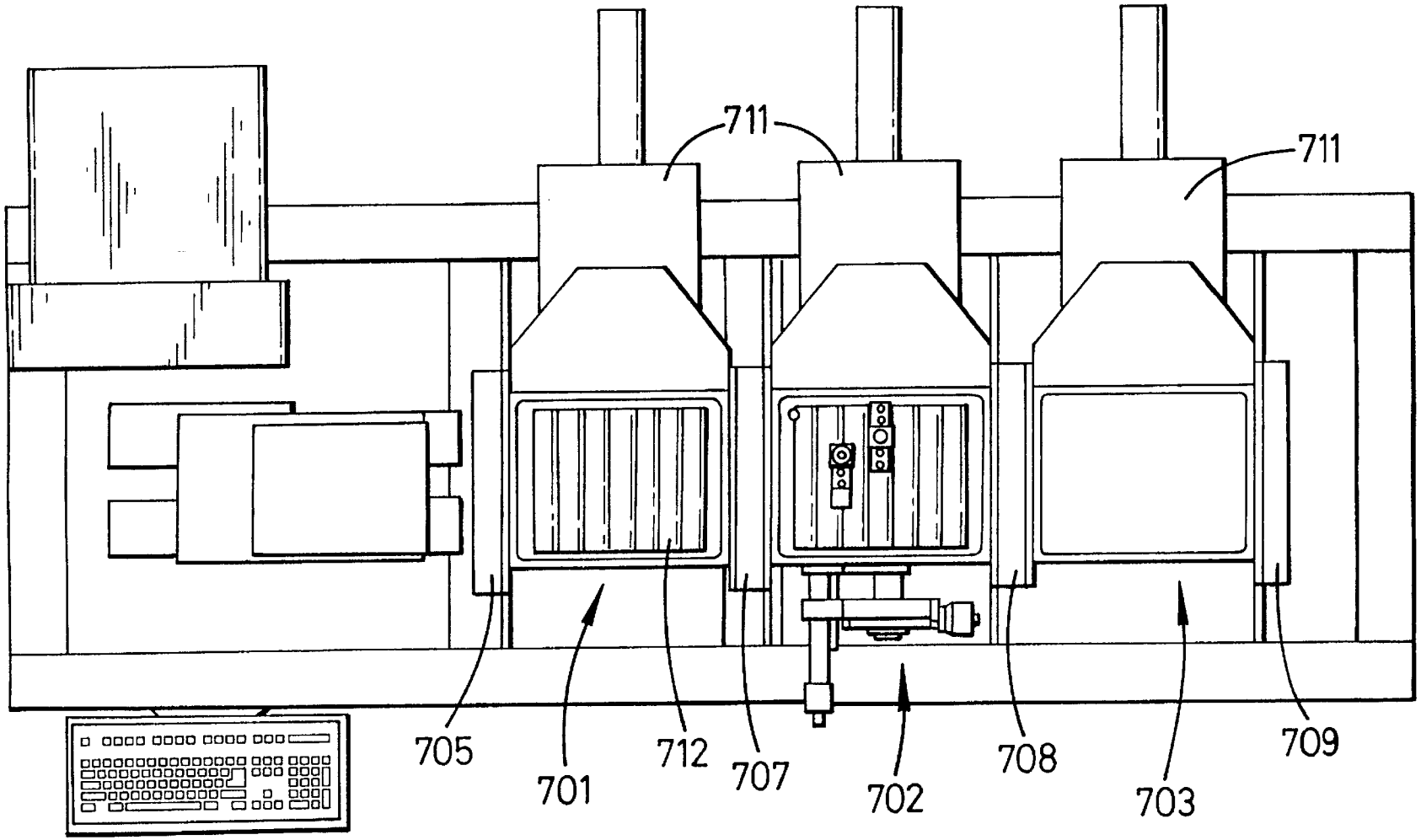
FIG. 33 is a plan view of the machine of FIG. 32.
Figure 34:
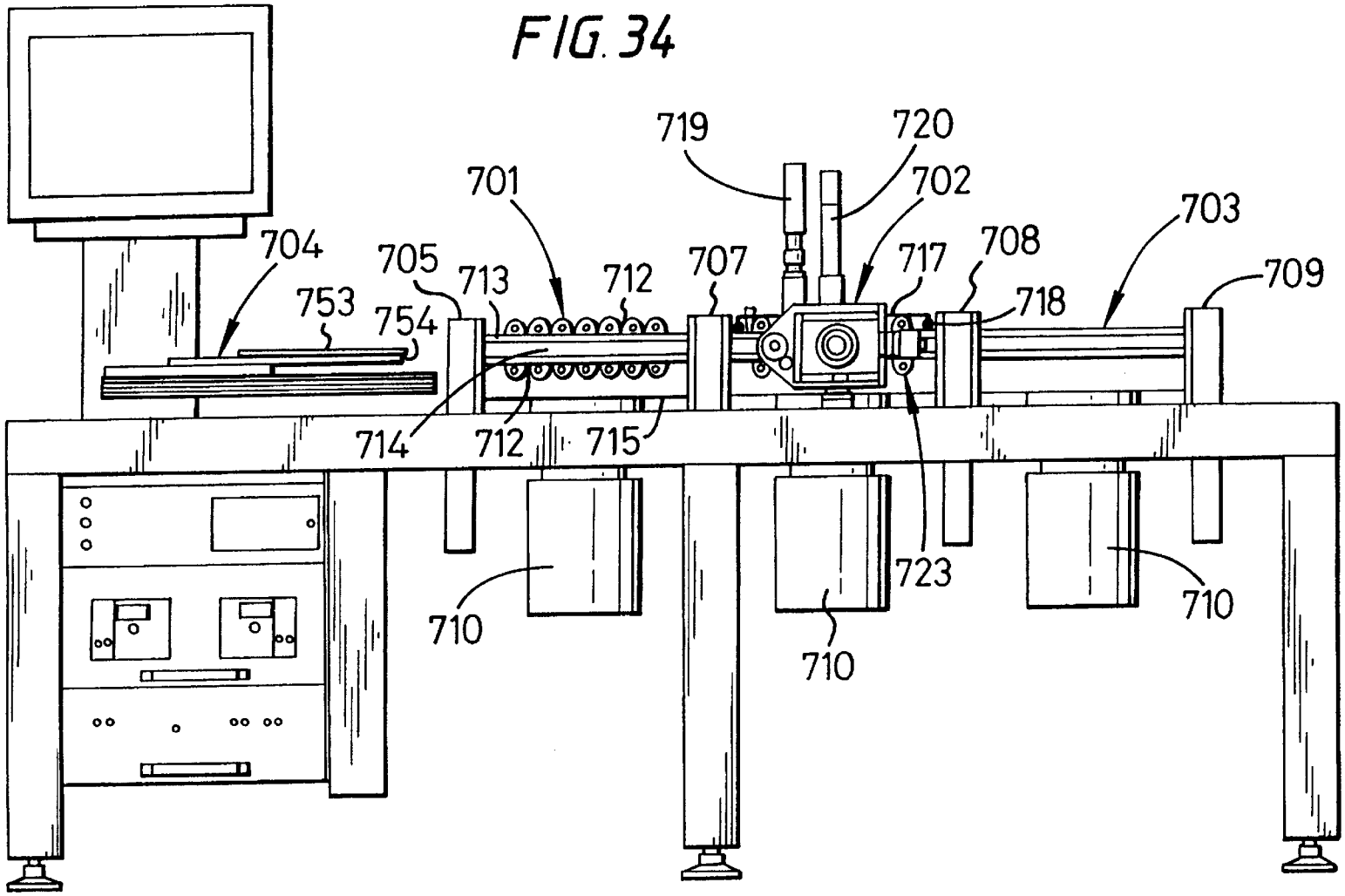
FIG. 34 is a front view of the machine of FIG. 32.
Figure 35:
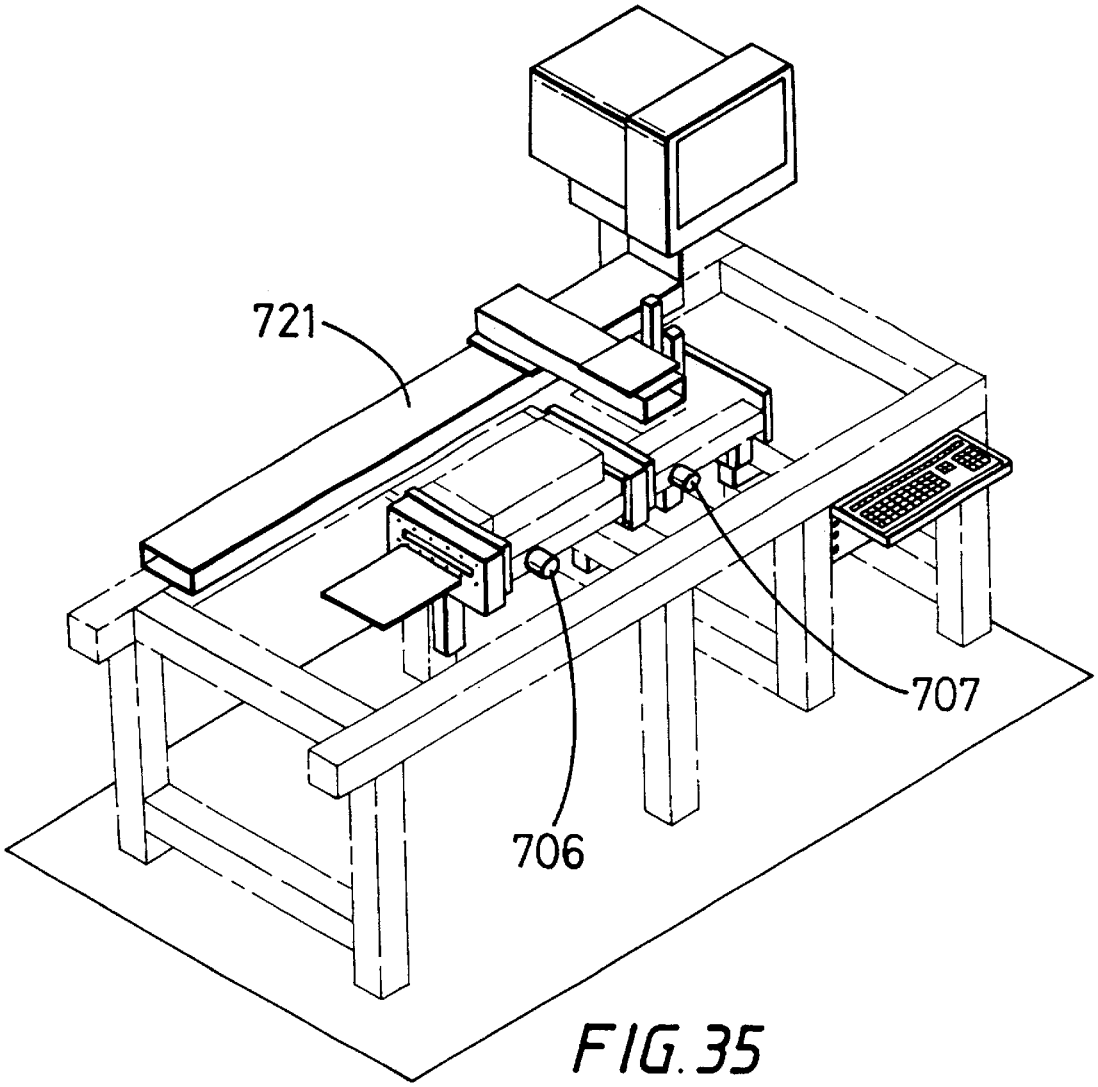
FIG. 35 is a view similar to FIG. 32 of this machine configured differently.

The final components to be added to the visual display after the front plate is sealed are the drivers 7 (see FIG. 30). These are soldered to the contact pads 18. At the same time a connector (not shown) is soldered to the contacts 48.

Figure 16:
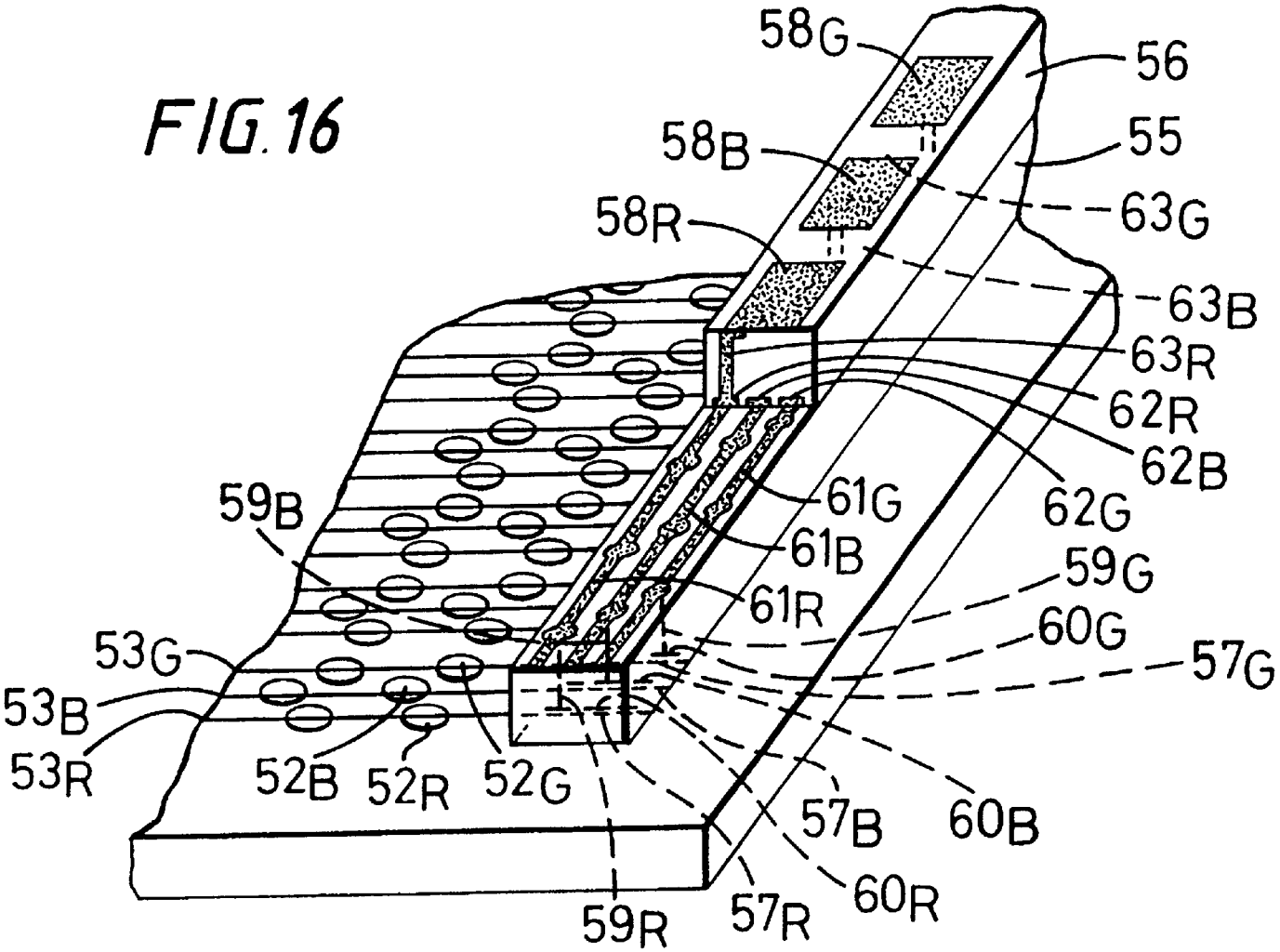
FIG. 16 is a broken away scrap perspective view of an outer spacer on the face plate of the visual display unit of FIG. 14.

Turning now to FIG. 16, the visual display, of which a portion is there shown, is a colour display. The phosphor material is provided as red, blue and green spots $52_R$,$52_B$, $52_G$ One of each spot is provided opposite each emission pixel, whereby that pixel can display a selected colour. The spots are arranged in a uniform array across the face plate, with red, blue and green voltage lines $53_R$,$53_B$,$53_G$ interconnecting respective coloured spots across the face plate. The lines terminate at outer spacers 54 arranged at opposite sides of the display. The outer spacers are of alumina ceramic, and are formed of two layers 55,56, with a via and connection track arrangement enabling contact ends $57_R$, $57_B$,$57_G$ of all of the lines of respective colours to be collectively connected to a respective common one of three contacts $58_R$,$58_B$,$58_G$. The upper layer 55, which is laser tacked at its ends to the face plate 51, has red, blue and green vias $59_R$,$59_B$,$59_G$; leading to red, blue and green contacts $60_R$,$60_B$,$60_G$ on its side in contact with the glass. The contacts 60 abut the respective contact ends 57. The vias of the respective colours are staggered across the width of the spacer layer 55, and lead through to red, blue and green contact strips $61_R$,$61_B$,$61_G$. Similarly the lower spacer layer 56 has red, blue and green contact strips $62_R$,$62_B$,$62_G$ running the length of its side abutted with the upper spacer layer, whereby each red, blue and green voltage lines $53_R$,$53_B$,$53_G$ is connected to the respective red, blue and green contact strips $62_R$,$62_B$,$62_G$. The lower spacer layer 56 also has red, blue and green contact vias $63_R$,$63_B$,$63_G$ connecting the strips 62 to red, blue and green contacts $58_R$,$58_B$,$58_G$ on the side of the outer spacer 54 opposite from the face plate. The contacts 58 are large and largely spaced apart in comparison with the inter-phosphor line spacing to enable the face plate's positioning with respect to the emission device to be made with a tolerance greater than the said line spacing. The emission device has complementary contacts $64_R$,$64_B$,$64_G$ in its emission layer as described above.

Figure 17:
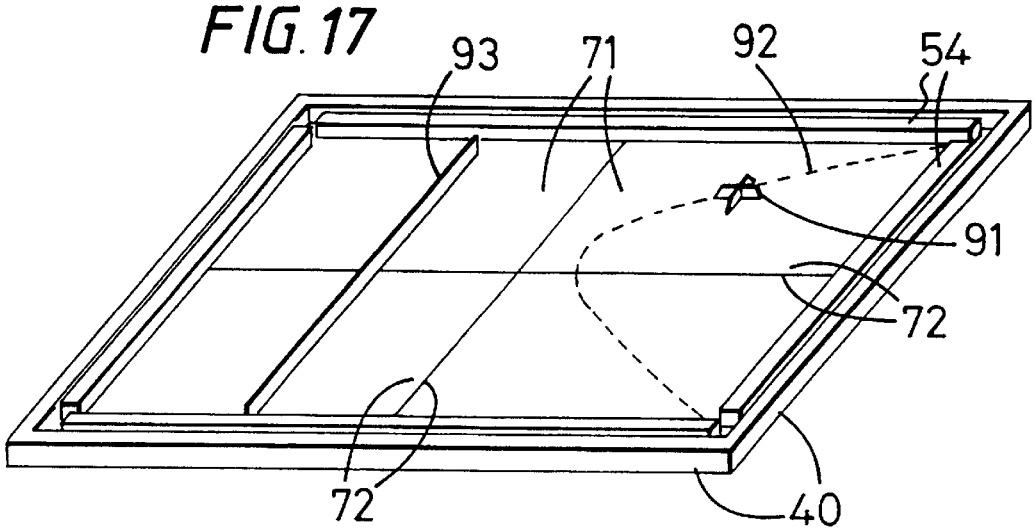
FIG. 17 is a view similar to FIG. 14 of a larger visual display unit of the invention, without its face plate being shown.

Reverting to FIG. 15, the visual display has a number of inner spacers 81 across its width, one only being shown. The spacer is for support of the face plate 51 and the ceramic substrate 1 against atmospheric pressure urging them towards each other. It is of tape cast ceramic, but could be of extruded glass. Typically it will be 0.002" thick and 0.050" high. It is set in a groove 82 in polyimide material in a phosphor layer 83. The polyiynide is apertured to give the emitted electrons access to the phosphor spots 52 and covered with a reflective chromium layer in the manner conventionally used in a cathode ray tube. The inner spacers are initially adhered to the face plate 51, before this is assembled to the emission device as described below. The emission layer 3, in particular the gate stripe material 5, is also provided with a groove 84 for the opposite edge of the inner spacer, the spacer 81 registering with the groove 84 on assembly. The grooves are formed at masks (not shown) in the build-up of the surrounding material. As shown the spacer has a conductive line 85 running along it. The line is connected to a contact pad (not shown) for application of a voltage to divert electron emission from the spacer. Whilst the spacer shown in FIG. 15 is of rectangular cross-section, it may be tapered towards the face plate to minimise its effect in the visual display. Further, it may not extend across the full width of the display. It is envisaged that cruciform inner spacers, extruded from glass, may be used in place of straight spacers, with the arms of the cross extending in line with the pixel array between the emitters in both directions. The cruciform shape may taper towards the face plate. Such spacers 91 set out in an elliptical pattern 92 are shown in FIG. 17. The pattern provides support over the entire area of the multiple emission device display there shown. Linear inner spacers 93 are also shown as an alternative in another portion of the display.

Description of Further Embodiments of the Visual Display

Figure 18:
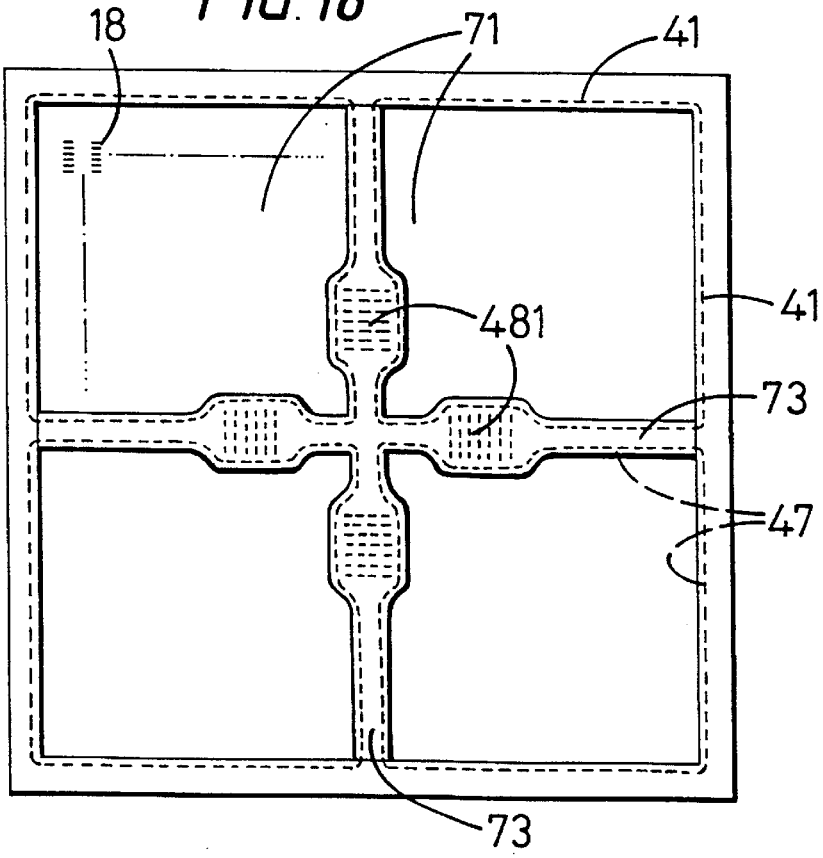
FIG. 18 is an underside view of the visual display unit of FIG. 17.

Turning now to FIG. 17 & 18, the display there shown is similar to that shown in FIGS. 14, 15 & 16, except that it is larger. The emission devices 71 included in it can be made only to certain dimensions, usually 4" square. To make the display larger, it has a plurality of emission devices abutted edge to edge. As shown, the display has four emission devices 71, giving it an 8" square size.

Figure 19:
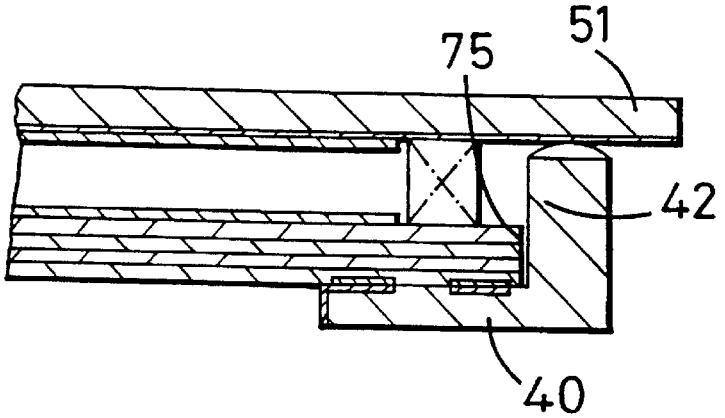
FIG. 19 is a view similar to FIG. 15, showing an arrangement for positioning emission devices on their carrier.
Figure 20:
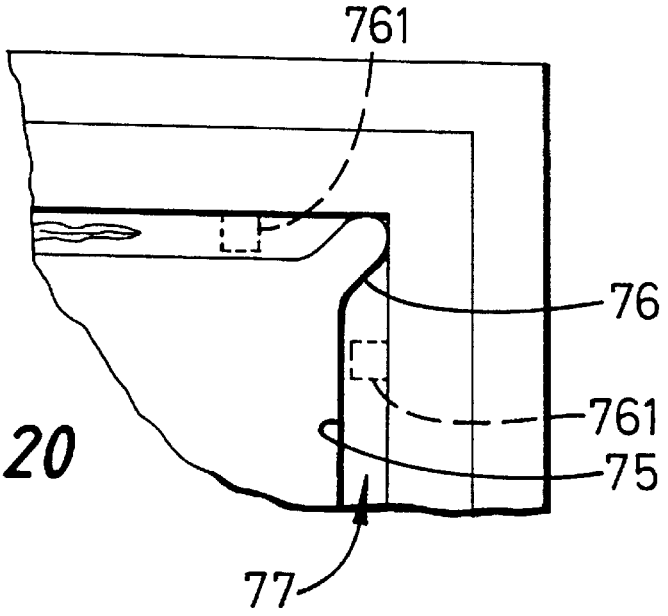
FIG. 20 is a plan view of a corner of another visual display of the invention, showing an alternative arrangement for positioning emission devices on their carrier.
Figure 21:
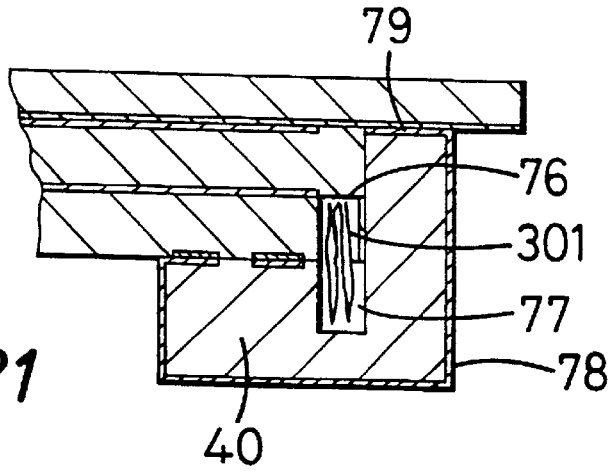
FIG. 21 is a view similar to FIG. 19 showing the alternative positioning arrangement of FIG. 20.

The emission devices 71 are identical with the emission devices 1, except that along two side edges 72, the edge zones are not present and the emitter and gate line arrays extend to the very edge of the ceramic substrate. One advantage of using alumina as a ceramic material of the substrates is that it can be cut, microdiced, to accurate tolerances. Thus the edges can be cut to be one half the pixel pitch from the emitter or gate line adjacent to the edge. The arrangement is such that where two emission devices are abutted edge-to-edge, the array of emission pixels is continuous from one device to the next. The other edges 75 of the emission devices can be machined to closely fit the side walls 42 of the carrier, along their length as shown in FIG. 19, to give positive alignment of the devices in the carrier. Alternatively, the edges 75 can be cut away between location projections 76, conveniently at the corners of the emission devices, as shown in FIGS. 20 & 21. This provides a channel 77 for a getter 301, such as described in more detail below. The channel is recessed into the carrier to accommodate a deep getter. As an alternative to the projections on the corners of the tiles, the carrier can be provided with location lugs 761 in the channel 77, which perform the same function. It should be noted that the front plates 51 of the displays shown in FIGS. 19, 20 & 21 extend laterally beyond the carriers 40. This facilitates connection to the phosphor lines when connection is not made through spacers and edge connectors (not shown) are used. The lateral extension also provides a rim which can be gripped for manipulation prior to sealing as described in more detail below. In FIG. 21, an alternative for phosphor line connection is provided in the form of connection tracks 78 on the outside of the carrier. They pass onto the top of the carrier, where contact is made with the phosphor lines via conductive frit 79.

To support the joints between two devices, the carrier is provided with additional flange pieces 73 bridging the side members of the carrier behind the joints in the devices. Thus in the four emission device display shown, the carrier forms a square surround with an internal cross. The emission devices are soldered to the cross piece 73 in the same way as to the flanges 41, that is to say with a high temperature solder joining strips around the back face of the devices to tracks 47 along the carrier members. The solder can braze, that is a brass or an indium based solder. Where the adjacent emission devices require to be interconnected for their synchronisation, contacts 481 on the carrier's bridging members and complementary contacts (not shown) on the emission devices are provided. They are joined in the high temperature soldering process. In order to provide room for the contacts 481 between the solder tracks 47, the latter and the bridging members 73 are locally widened, with the contacts 481 provided between the tracks.

Figure 22:
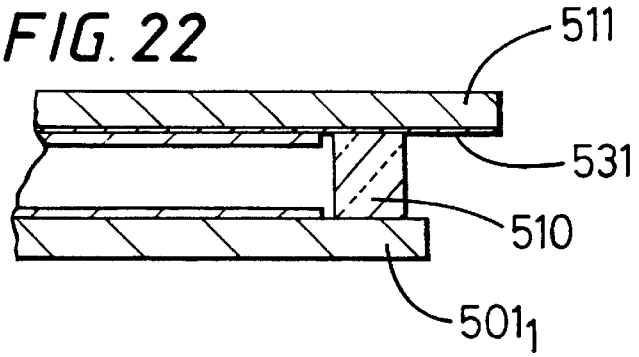
FIG. 22 is a scrap cross-sectional side view of a single substrate layer visual display of the invention.

Turning now to FIG. 22, a simpler form of visual display of the invention is shown where the face plate 511 is connected to the single substrate layer emission device $\mathbf{501}_1$ of FIGS. 9 & 10, by means of a thick, glass frit strip 510, without the interposition of any wall. The phosphor lines 531 are not taken to the substrate, but pass straight out sideways for connection to drivers (not shown).

Figure 23:
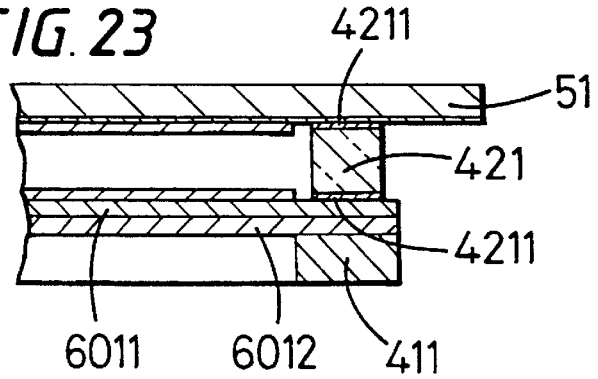
FIG. 23 is a similar view of a double substrate layer visual display of the invention.

FIG. 23 shows another simple display, this having two substrate layers. Again the face plate 511 and the substrate 6011,6012 are joined without the interposition of a carrier. A glass wall 421 is attached between the two and adhered to them by ultra-violet light curing adhesive 4211, on both sides. The adhesive is cured at both sides of the wall by a single irradiation of UV light. To provide additional structural strength, the emission device is adhesively secured to a plastics material carrier 411 at the back of the device.

Description of a First Embodiment of Assembly Apparatus of the Invention

Figure 24:
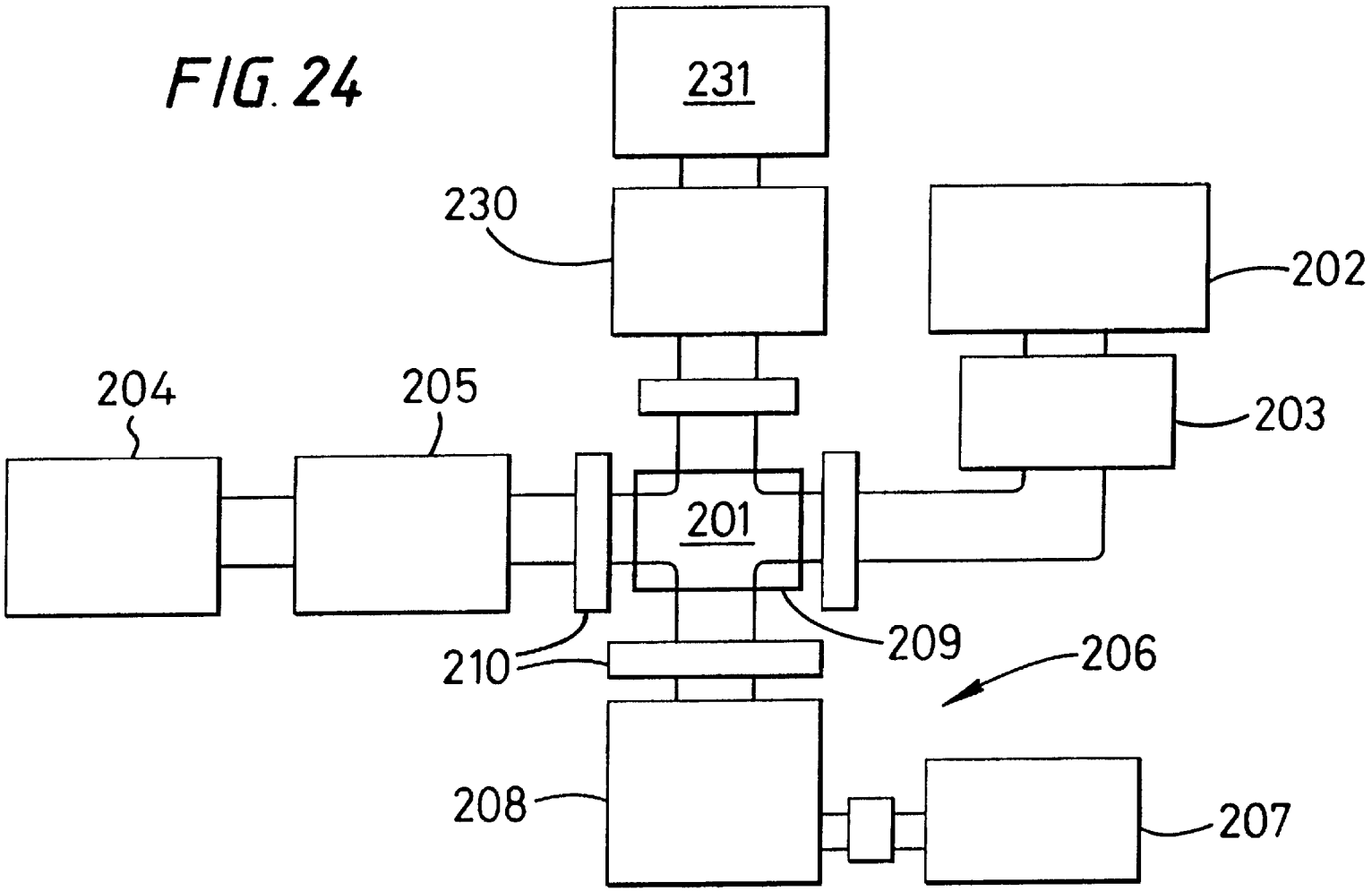
FIG. 24 is a block diagram of assembly apparatus according to the invention.
Figure 25:
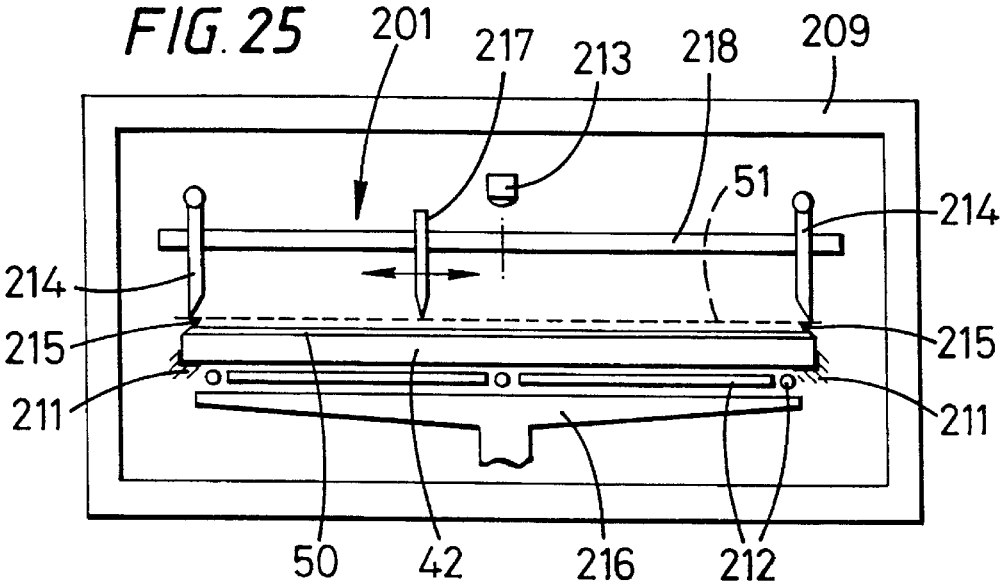
FIG. 25 is a cross-sectional side view of an assembly station with a face plate shown only in outline.
Figure 26:
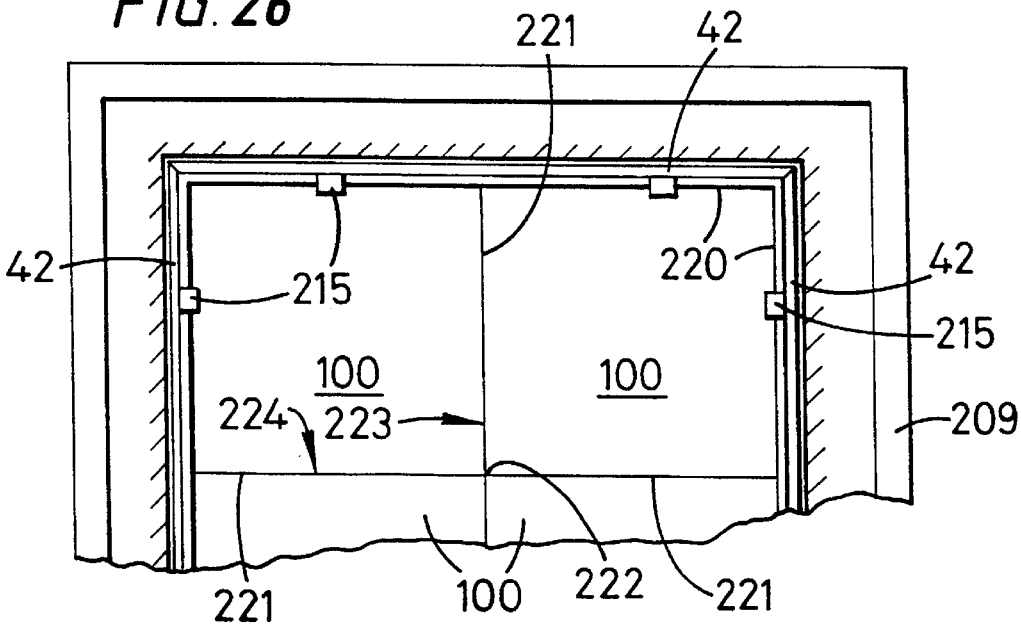
FIG. 26 is a partial plan view of the assembly station without a face plate.

Referring to FIGS. 24 to 26, the assembly apparatus there diagrammatically shown has an assembly station 201 with a number of ancillary stations associated with it, in particular an emission device cleaning station 202, a sub-assembly pre-heating station 203, a face plate cleaning station 204, a face plate pre-heating station 205 and an evacuation unit 206. Components are moved between the stations by means whose design is within the ability of the man skilled in the art and will not be described here.

The emission device cleaning station 202 incorporates a cleaning emission device 101, as described below, set up for cleaning emission devices 1 to be assembled. The sub-assembly pre-heating station 203 incorporates heaters (not shown) for heating a sub-assembly of however many—four as shown in FIG. 26—of the emission devices 1 on their carrier 40 as will be assembled into a visual display. The face plate cleaning station 204 has another such cleaning emission device 101 similarly set up for cleaning face plates 51 to be assembled. The emission device preheating station 205 incorporates heaters (not shown) for heating the face plate 51 to be assembled into the visual display. The evacuation unit 206 comprises a roughing pump 207 and a high vacuum pump 208 in series. The assembly station 201 includes a vacuum chamber 209, in which the assembly is carried out. Vacuum lock valves 210 through which components can be passed whilst maintaining a vacuum in the chamber 209 are provided.

Within the chamber 209, there is a datum jig 211 for locating the carrier 40, on introduction of a sub-assembly through the valve 210 from its pre-heating station 203. Below the jig are positioned radiant heating elements 212 aligned with the carrier's flanges 41,73 for heating them to the temperature at which solder between them and the ceramic substrates 1 melts.

Over the jig 211 is arranged at least one optical position sensor 213 and a plurality of robotic arms 214, for manoeuvring the substrates 1 on their carrier to their design position. Once positioned, they are temporarily secured by aluminium wedges 215, which were included with the sub-assembly and which are pressed into position by the robotic arms. The same robotic arms are adapted for manoeuvring the face plate 51 (shown in outline in FIG. 25) into position on the positioned sub-assembly.

Adjacent the radiant heating elements 212 are ducts 216 leading to the vacuum unit for drawing air flow past the flanges 41,73 for cooling of the solder once the emission devices have been positioned and wedged.

Within the chamber 209, also mounted over the jig 211, is provided a tacking laser 217 on a track 218 allowing it to be moved into alignment with various points on the periphery of the carrier for tacking of the face plate 51 to the glass frit 50 on the wall 42 of the carrier.

Description of the Preferred Method of Cleaning the Emission Device

Figure 31:
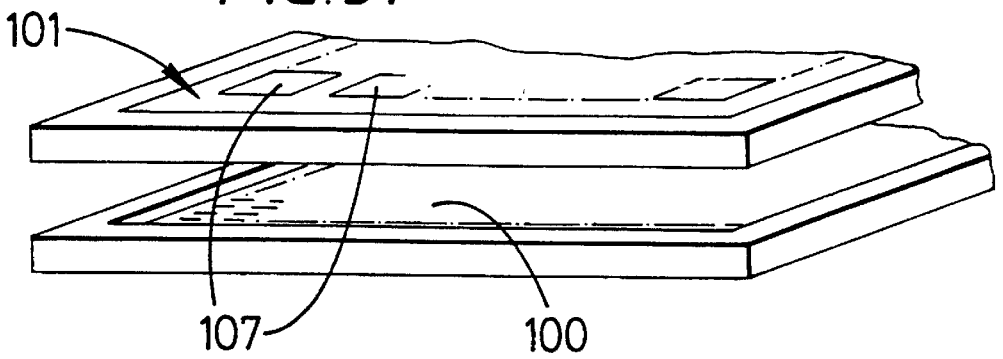
FIG. 31 is a perspective view of a emission device set up for cleaning by a similar device.

In FIG. 31 is shown the emission device of FIG. 1 arranged opposite another similar device 101, having its drivers 107 controlled to provide a maximum electron beam irradiation of the emission layer 3 of the device 100. The devices are set up close to each other, preferably but not necessarily in a vacuum chamber. They are sufficiently close for the electron irradiation from the device 101 to activate and displace any molecular debris on the emission device which cannot be removed by conventional washing techniques.

The emission device 101 is powered for a length of time sufficient for cleaning of the device 100.

Description of the Assembly Method Using the First Assembly Apparatus

Turning again to FIGS. 24 to 26, a sub-assembly of four emission devices 1 on a carrier 40 is introduced into the emission device cleaning station 202, where the devices are electronically cleaned as described above. The sub-assembly is then moved on, on guides which are not shown, to the sub-assembly pre-heating station 203, where it is pre-heated. Again it is moved on to the assembly station 201. Simultaneously, a face plate is cleaned at face plate cleaning station 204 and preheated at the pre-heating station 205. The vacuum chamber 209 is pre-heated and evacuated to a substantial vacuum by means of the pumps 207,208.

The sub-assembly is introduced into the vacuum chamber via the vacuum lock 210 and positioned on the jig 211. Preliminarily to having been cleaned, high temperature solder, i.e. having a melting point of c.300° C., was screen printed onto strips 21 and tracks 22 of the substrates 1. The temperature in the pre-heat station is not hot enough to melt the solder, but the heating elements 212 heat the carrier and the substrates locally to melt the solder and cause it to flow and wet the complementary track 47 and contacts 48 on the carrier.

Whilst the solder is still molten, the robotic arms are manipulated to contact the free edges of the 220 of the emission devices. One optical sensor 213 is located centrally of the emission devices and can detect the joint lines 221 between the devices. The four joint lines between the four devices meet in a cross 222 of which the opposite limbs 223,224 align when the emission devices are correctly positioned with respect to each other. The central sensor is associated with a light recognition system (not shown) such that it can control the robotic arms 214 to manipulate the emission devices into correct positioning. To ensure correct rotational positioning on the carrier, farther sensors 213 are provided radially of the cross 222. Once the positioning is correct, the robotic arms are used to press the aluminium wedges 215 into position between the edges 220 and the walls 42 of the carrier—the wedges having been added to the sub-assembly prior to its cleaning.

Immediately on wedging, the vacuum pumps are operated, to draw out the air introduced with the sub-assembly and the face plate which is now introduced. The inlets to the pumps are the ducts 216 adjacent to the heating elements, whereby the cooling effect of the flow of withdrawn air is concentrated locally to the soldered joints which now solidify. This creates a hermetic seal peripherally of each emission device.

The face plate is introduced to rest via its spacers 54 on the emission devices. The respective contacts 63 and 64 align. A small gap 223 (see FIG. 15) is present between the underside of the face plate at its edges and the frit 50 on top of the walls. Erasable, printed symbols (not shown) on the front of the face plate are viewed by the sensors 213, and the robotic arms manipulate the face plate into pixel/pixel alignment with the emission devices. With the face plate held by the robotic arms, the laser 217 is activated to make tacks between the glass of the face plate and the frit 50. It should be noted that the frit has a trapezoidal cross-sectional shape, which causes it to form an upwardly curved meniscus when it is melted by the laser. This enables the joint between the frit and the face plate to jump the gap 223, which is of the order of 0.020" (0.5 mm). Typically four tacks are made, one at each edge of the rectangular face plate. The latter is thus held in fixed position with respect to the carrier, to which the emission devices have been fixed on solidification of the solder.

Description of a First Embodiment of Sealing Apparatus of the Invention

Connected to the vacuum chamber 209 via one of its lock valves 210 is a second, high vacuum chamber 230 with a separate high vacuum pump 231. The chamber is equipped with a jig 232 similar to the jig 211 and a laser 233 and track 234 similar to the laser 217 and its track 218 in the first vacuum chamber 209.

Description of the Sealing Method Using the First Sealing Apparatus

Figure 27:
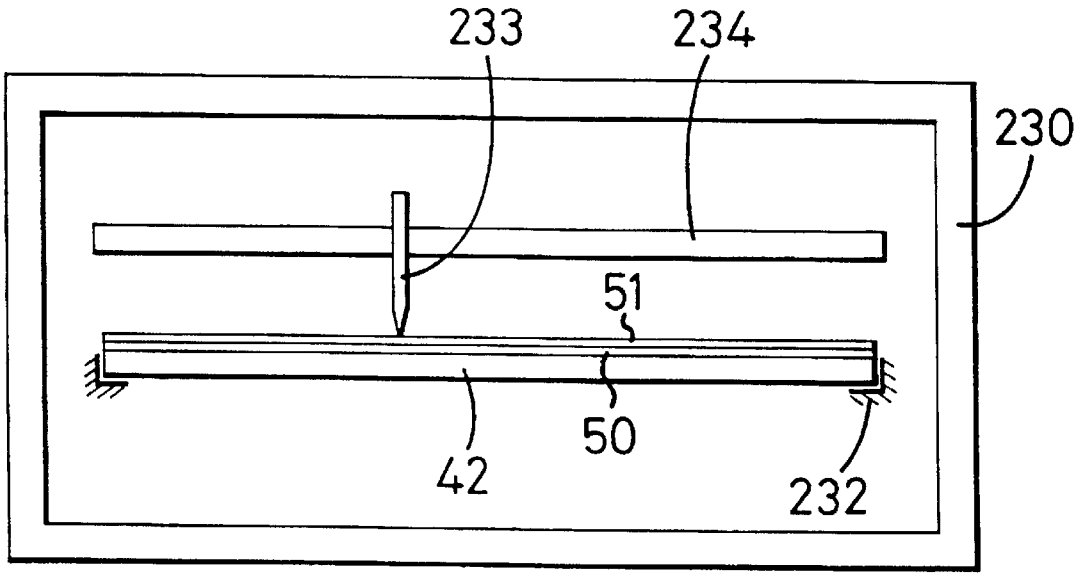
FIG. 27 is a cross-sectional side view of a sealing chamber.

Referring to FIG. 27, on introduction of the visual display into the sealing chamber 230 and its positioning on the jig 232, the pump 231 is operated to draw a high vacuum in the chamber. The laser 233 is aligned with the frit 50 at the periphery of the face plate, either at a preliminary tack or elsewhere. The laser is fired and traversed around the entire periphery of the face plate, welding it to the frit in the same manner as the tacks were made. Since the gap exists between the face plate and the frit prior to the welding, the evacuation can be continued simultaneously with the welding, with air being evacuated from the display via the gap. Completion of the traverse of the periphery completes the sealing.

Description of the Preferred Visual Display Evacuator of the Invention

Figure 28:
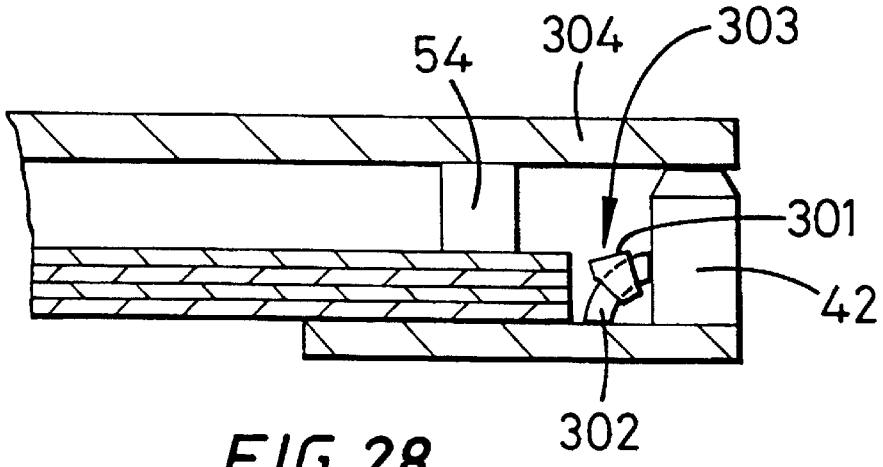
FIG. 28 is a view similar to FIG. 15 showing an evaporatable getter according to the invention.

Referring to FIG. 28, the visual display of which a portion is there shown has an evaporatable getter 301 of barium. It is of foil twisted around quadrant pieces 302 of ceramic material spaced along the carrier 40. The getter is positioned in the space 303 between a spacer 54 and the carrier wall 42, whereby on evaporation of the getter by irradiation with a laser acting through a clear marginal piece 304 of the face plate, the evaporated material deposits on the surfaces around the space, which do not include active parts of the emission layer nor of the face plate.

Figure 29:
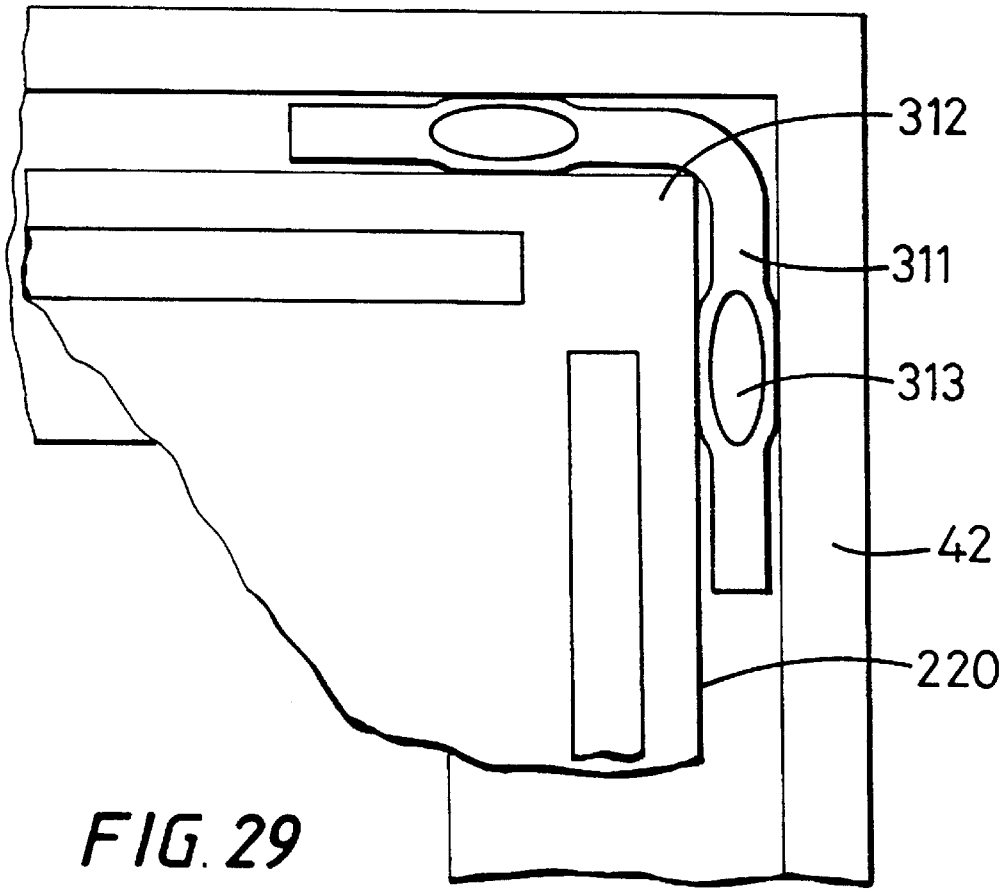
FIG. 29 is a scrap plan view of a corner of a visual display unit showing another, deformable getter according to the invention.

FIG. 29 shows an alternative, non-evaporatable getter 311, extending a corner 312 of each emission device 100. The getter is formed as an invert C with the ends of the limbs between the edges 220 of the ceramic substrates and the walls 42 of the carrier. The arrangement is such that pressure on the upper part 313 of the getter section spreads it to cause it to act as a wedge during positioning of the emission devices.

Description of the Preferred Evacuation Method of the Invention

After sealing of the visual display with either an evaporatable or a non-evaporatable getter 301,311, the laser 234 is traversed to heat the getter to its active temperature at which it will absorb the majority of any gases still present in display after sealing. The activation of the getter can be immediately subsequent to the sealing whilst the display is still in the sealing chamber 230. Alternatively, it can be carried out later at room temperature.

The completed visual display is prepared for use by screen printing solder onto the contact pads 18 for soldering on of its driver chips 7.

Description of a Second Embodiment of Combined Assembly and Sealing Apparatus

Turning now to FIGS. 32 to 35, the apparatus there shown is for assembling face plates 753 to pre-assembled emission devices and carriers 754, referred to below as cathodes.

The emission devices and carriers are pre-assembled in a station—not shown—which heats them to melt the solder joining them and cools them to set the solder.

Use of emission devices cut to fit their carrier avoids the need for manipulating them with respect to the carrier. Getter strips 301 are added to the channels 77, to complete pre-assembly of the cathodes.

The apparatus has three stations 701,702,703. The first 701 is a preheater, the second 702 is an alignment and irradiation station and the third 703 is a controlled cooling station. A conveyor 704 is provided for feeding superimposed face plates and cathodes through a first gate valve 705 into the preheater. Thence, an internal conveyor operable by a knob 706 moves them through another gate valve 707 to the second station 702 and through a third gate valve 708 to the cooling station 703. It has a final gate valve 709 through which sealed field effect emission devices are removed.

Beneath each station, a vacuum pump 710 capable of drawing ultra-low pressures is provided. Each station is isolatable from its pump by a gate valve 711.

The preheater is precisely that and is equipped with upper and lower banks of radiant heaters and reflectors 712. The upper heaters are provided above a quartz window 713 of a chamber 714 constituting the station. The lower heaters are provided within the chamber, that is above a bottom plate 715 of it which incorporates an aperture to the station's gate valve and vacuum pump. The heaters heat the face plate and cathode to a temperature close to but lower than the melting point of the solder uniting the emission devices with the carrier. This temperature is not exceeded in the apparatus except locally on melting of the frit. The pressure in the preheater is pumped down to that in the alignment and irradiation station prior to opening of the gate valve between them and transfer of the face plate and cathode, with the result that this second chamber is kept constantly evacuated.

At the alignment and irradiation station, further heaters 716 are provided. Those above the face plate and cathode, the face plate being uppermost, are mounted on frames 717 about hinges 718, whereby they can be swung up to clear this station's top quartz window, exposing the face plate to the view of an optical system 719 and a laser 720. These are mounted on an X-Y stage 721 extending from the back of the apparatus.

The conveyor in this station 702 can be locked stationary, thereby locking the cathode stationary. Manipulation controls 722 are provided for manipulating the position of the face plate to be in pixel alignment, as measured by the optical system 719, with the cathode. The optical system is adapted to measure not only X-Y alignment, but also parallelism and Z separation. Once the X-Y alignment and the parallelism is correct, the station is finally pumped to $10^{-x}$ Torr and the face plate is lowered to a controlled small separation from the frit on the carrier wall. The laser is traversed around the frit at close to full power to degas finally the frit. The laser is then traversed again at full power. The final traverse melts the frit which was already close to its melting point. One traverse only at full power is adequate to cause the frit to rise by capillary action into contact with the face plate and freeze off once the laser has been traversed further. Continuous traverse of the frit provides that it is only local to the present position of the irradiation that the temperature of the frit is brought to its glass melting point. Elsewhere, the components are held cooler and below the melting point of the high temperature solder. Localising the elevated temperature at the laser obviates substantial thermal stress build up and resultant cracking. A small overlap is provided at the end of the traverse. As soon as the frit has frozen off at the overlap, the laser's travel is changed to irradiate the portions of getter material provided in the channel in the carrier.

The cooling station 703 has meanwhile been pumped down and the sealed device is transferred to it. The temperature of the device is allowed to rise very slowly, in order to reduce the risk of thermal cracking to as great an extent as possible. As the temperature slowly falls, air is slowly introduced, so that the finished device can be removed to the ambient surroundings.

Figure 36:
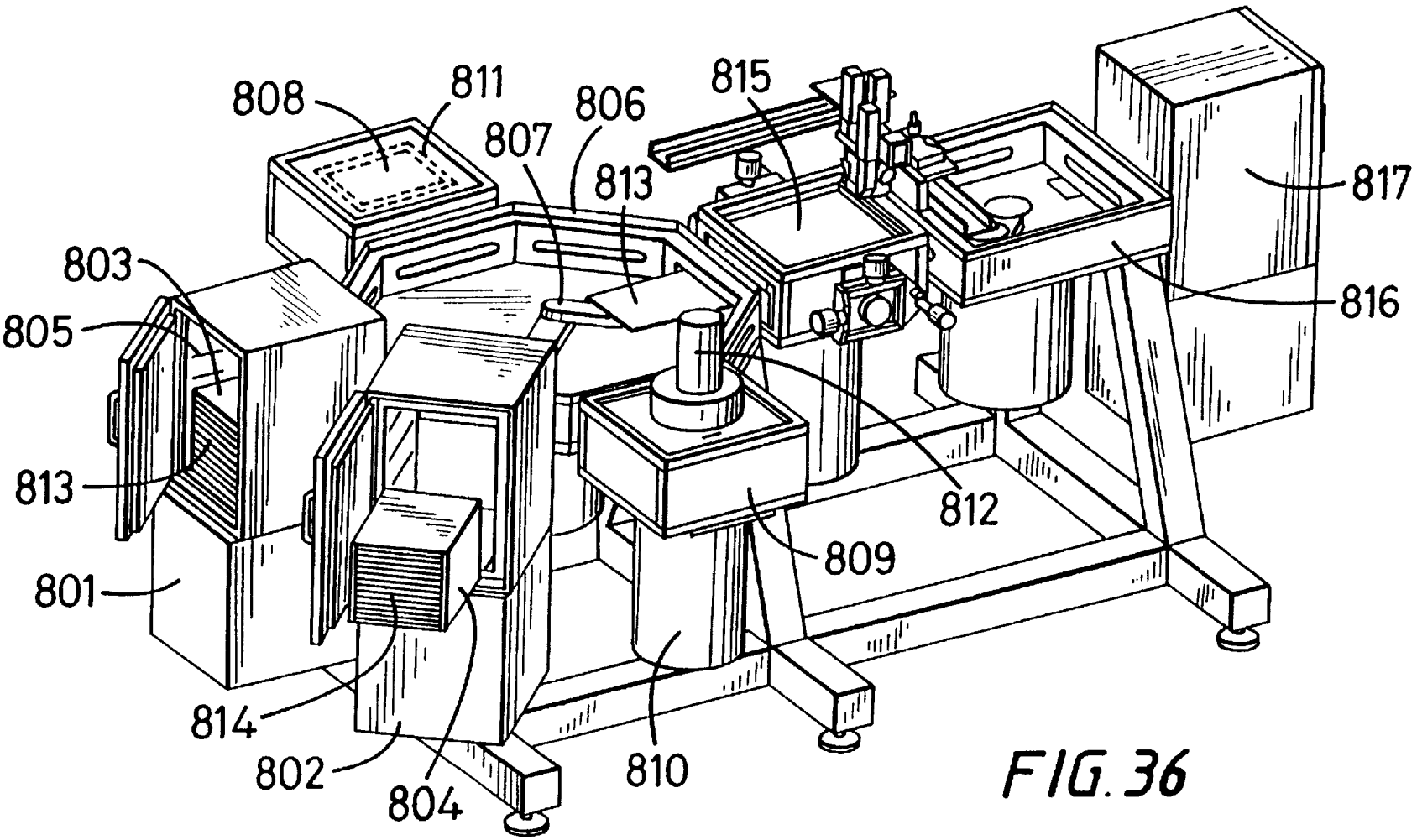
FIG. 36 is a similar view of a third sealing machine of the invention.

Referring now to FIG. 36, an alternative sealing apparatus is there shown, which is adapted to higher volume, automated processing. At the input end of the apparatus, a pair of pods 801,802 are provided, in which are respectively loaded cassettes 803,804 of face plates and cathodes. The pods are provided internally with heaters 805 and vacuum pumps (not shown) The pods are connected to an input robot station 806, with a robotic arm 807. Two cleaning stations 808,809 are provided peripherally of the robot station 806. Each has its own vacuum pump 810. They are provided with electron and/or ion radiation sources 811,812, the former being an emission device of the invention and the later being a source of inert gas plasma, for instance The robotic arm is adapted to unload the face plates and cathodes 813,814 from their pods for cleaning at the stations 808,809. Here a face plate is irradiated under vacuum to degas the phosphor material in particular, to ensure that it does not release further gas in service. Similarly the cathodes are irradiated to remove molecules clinging to the tips of the emitters in particular. The cleaned devices are then loaded into a sealing station 815, essentially similar to station 702 of the previous embodiment. Downstream of this is an output robot 816, adapted to take sealed displays from station 815 and load them into a cassette (not shown) in an output pod 817. This has temperature and pressure control for slowly returning the finished displays to ambient temperature.

The pods are detachable from the robots as their cassettes are emptied and refilled.

The apparatus described is essentially modular, whereby the cleaning stations and the sealing stations can be duplicated as necessary to avoid the speed of the slowest limiting the processing speed of the entire apparatus.

What is claimed is:

1. A method of sealing a visual display having:

at least one field emission device including an emission layer on a substrate;

a glass face plate carrying excitable phosphor material; and fused sealing material peripherally sealing the face plate to the emission device(s), whereby the face plate is parallelly spaced from the emission layer, the method consisting in the steps of:

evacuating the display so as to evacuate the space between the emission layer and the face plate to a vacuum at which they can be sealed together, the evacuation being carried out with the glass face plate and the field emission device spaced from each other; positioning the face plate and the field emission device in their relative X/Y (pixel to pixel alignment) position subsequently to the start of the evacuation;

positioning the face plate and the field emission device in their relative Z (separation) position subsequently to the evacuation to the sealing vacuum; and irradiating a peripheral region of the face plate to fuse the sealing material, thereby sealingly securing the face plate to the emission device(s).

2. A sealing method as claimed in claim 1, wherein the step of positioning the face plate in pixel to pixel alignment with the emission device is performed by robotic manipulation.

3. A sealing method as claimed in claim 1, wherein the emission device is supported on a carrier and the method includes the step of preliminarily sealing the device to the carrier.

4. A sealing method as claimed in claim 3, wherein the carrier supports a plurality of emission devices and the method includes the steps of:

positioning the emission devices in pixel line alignment and provisionally securing the devices with respect to the carrier, prior to sealing, by means of wedges between the emission devices and peripheral portions of the carrier.

5. A sealing method as claimed in claim 3, wherein the emission device(s) are sealed to the carrier by soldering, the device(s) and the carrier being heated for melting of the solder and cooled for setting of it.

6. A sealing method as claimed in claim 5, wherein the cooling is provided on evacuation of a vacuum chamber with an outlet from the chamber directing air flow from the chamber to the solder joint for its cooling.

7. A sealing method as claimed in claim 5, wherein the carrier and emission device(s) are heated for soldering to above the melting point of the solder prior to loading into the vacuum chamber.

8. A sealing method as claimed in claim 1, wherein the irradiation is performed by traversing along the sealing material with an irradiation source, the traversing being by movement of the irradiation source or the face plate and emission device(s) or both.

9. A sealing method as claimed in claim 8, wherein preliminarily to the traversing, irradiation is carried out at spaced intervals around the fusible sealing material to tack the face plate in position.

10. A sealing method as claimed in claim 9, wherein a plurality of lasers are used for the irradiation step, either in sequence to assure complete fusing of the frit and/or at opposite positions to allow speedy traverse.

11. A sealing method as claimed in claim 9, wherein the evacuation is continued during the irradiation step, and wherein frit is so shaped as to be able to bridge a face plate/carrier gap established by the height of spacers between the face plate and the emission layer of the emission device(s).

12. A sealing method as claimed in claim 9, wherein the face plate and emission device are heated to elevated temperature during the laser irradiation.

13. A sealing method as claimed in claim 12, wherein the elevated temperature is lower than that at which the emission device is soldered to another component.

14. A sealing method as claimed in claim 1, wherein the sealing material is fusible glass frit, and the irradiation step is performed with a laser.

15. A sealing method as claimed in claim 1, wherein the sealing material is fusible under ultra-violet light, and the irradiation step is performed by an ultra-violet light source.

16. A sealing method as claimed in claim 15, wherein a peripheral glass wall is provided with UV curable adhesive at one surface in abutment with the face plate and at an opposite surface in contact with the carrier or the emission device and the irradiation fuses the adhesive at both surfaces.

17. A sealing method as claimed in claim 1, wherein the evacuation and irradiation steps are carried out in the same station as the positioning of the face plate.

18. A sealing method as claimed in claim 17, wherein the evacuation and irradiation steps are carried out at sequential stations.

19. A sealing method as claimed in claim 1, including preliminary cleaning of the face plate and/or the emission device(s) by irradiating it or them with one or more electron beams and/or ion streams.

20. A sealing method as claimed in claim 19, wherein the irradiation is carried out with a field emission device.

21. A sealing method as claimed in claim 19, wherein the cleaning is carried out under partial or complete vacuum.

22. A sealing method as claimed in claim 19, wherein the cleaning is carried out in air.

23. A sealing method as claimed in claim 19, wherein the sealed visual display is cooled at a station sequential to that at which the irradiation step is performed.

24. A sealing method as claimed in claim 1, including a step subsequent to irradiation for sealing of irradiation of an activatable getter for final evacuation of the display.

25. A sealing method as claimed in claim 24, wherein the getter irradiation is by laser.

26. A sealing apparatus for sealing a visual display having a field emission device with an emission layer on a substrate and a face plate with excitable phosphor material, the apparatus being wherein it comprises:

a vacuum chamber;

means in the vacuum chamber for supporting the field emission device and the face plate juxtaposed in pixel to pixel alignment, the support means including means for positioning the face plate and the field emission device in their relative Z (separation) position subsequently to the evacuation to the sealing vacuum; and an irradiation device adapted and arranged to irradiate sealing material provided on the device or the face plate thereby fusing the material to seal the visual display.

27. A sealing apparatus as claimed in claim 26, wherein the vacuum chamber includes its own evacuation pump.

28. A sealing apparatus as claimed in claim 26, wherein the irradiation device is mounted inside the vacuum chamber.

29. A sealing apparatus as claimed in claim 26, wherein the irradiation device is mounted outside the vacuum chamber, the chamber being provided with a window through which the irradiation can pass.

30. A sealing apparatus as claimed in claim 29, wherein at least some heaters of the vacuum chamber are arranged outside the window provided for the irradiation to enter the chamber.

31. A sealing apparatus as claimed in claim 30, wherein the said heaters arranged outside the window are so arranged on a frame that they can be swung clear of the window to expose it to the irradiation device.

32. A sealing apparatus as claimed in claim 26, wherein the irradiation device is a laser.

33. A sealing apparatus as claimed in claim 26, wherein the irradiation device is an ultra-violet light source.

34. A sealing apparatus as claimed in claim 26, wherein the support means includes a manipulator for manoeuvering one of the field emission device and the face plate into pixel to pixel alignment with the other, and the apparatus includes means for measuring the relative position of the emission device and the face plate, whereby the manipulator can position them in pixel to pixel alignment.

35. A sealing apparatus as claimed in claim 26, including heater(s) for heating the emission device and face plate prior to irradiation.

36. A sealing apparatus as claimed in claim 26, including a pre-heating and preliminary evacuation chamber provided with heater(s), an evacuation pump and means for transferring the emission device and face plate to the vacuum chamber.

37. A sealing apparatus as claimed in claim 36, wherein the transfer means are adapted to transfer the emission device(s) as assembled onto a carrier.

38. A sealing apparatus as claimed in claim 37, wherein the heaters of the preliminary evacuation chamber are adapted to heat the emission device(s) and the carrier to sufficient temperature to melt solder and the evacuation means is adapted to direct evacuated air flow to the solder region to cool it after melting.

39. A sealing apparatus as claimed in claim 38, including means for manoeuvering the emission device(s) with respect to the carrier for their soldering desired relative position.

40. A sealing apparatus as claimed in claim 26, including a cooling chamber provided with means for controlling the cooling of the visual display and means for transferring the visual display from the vacuum chamber to the cooling chamber.

41. A sealing apparatus as claimed in claim 26, including a robotic input station and removable input pods adapted to be connected thereto, the removable input pods being adapted to accommodate a plurality of emission devices and face plates in cassettes themselves removably mounted in the input pods, and the robotic input station being adapted to unload the emission devices and the face plates from the input pods for processing in the apparatus.

42. A sealing apparatus as claimed in claim 41, wherein the pods are adapted to receive removable cassettes containing the emission devices and the face plates respectively.

43. A sealing apparatus as claimed in claim 41, wherein the removable input pods include means for their heating and/or evacuation.

44. A sealing apparatus as claimed in claim 26, including a robotic output station and a removable output pod, the robotic output station being adapted to remove sealed displays from the vacuum chamber and load them into the output pod, the latter having means for controllably returning the sealed displays to ambient pressure and temperature.

* * * * *

UNITED STATES PATENT AND TRADEMARK OFFICE

CERTIFICATE OF CORRECTION

PATENT NO. : 6,517,403 B1 
DATED : February 11, 2003
INVENTOR(S) : Cooper et al.

It is certified that error appears in the above-identified patent and that said Letters Patent is hereby corrected as shown below:

Title page,
Item [57], ABSTRACT,
Line 10, "Prouided" should be -- provided --
Line 11, after "quartz" ":" should be deleted
Line 23, after "be" -- in -- should be inserted
Line 25, after "around", line 28 of PCT abstract is missing -- frit...traversed -- should be inserted Column 5,
Line 16, after "chips" "," should be -- ; --
Line 22, after "32" "," should be -- ; --

Column 9,
Line 59, after "$52_G$" -- . -- should be inserted

Column 10,
Line 33, "polyiynide" should be -- polyimide --

Signed and Sealed this

Fourteenth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,517,403 B1 
DATED : February 11, 2003
INVENTOR(S) : Cooper et al.

It is certified that error appears in the above-identified patent and that said Letters Patent is hereby corrected as shown below:

Column 3,
Line 35, after “device” -- . -- should be inserted.

Column 8,
Line 49, “a” should be -- α --

Line 53, " y" should be - - ч - -

Column 16,
Line 27, after “(not shown)” -- . -- should be inserted

Signed and Sealed this

Twenty-seventh Day of April, 2004

JON W. DUDAS
*Acting Director of the United States Patent and Trademark Office*